US010730326B2

(12) United States Patent
Perry et al.

(10) Patent No.: US 10,730,326 B2
(45) Date of Patent: Aug. 4, 2020

(54) MEDIA PROCESSING DEVICE AND ASSOCIATED SYSTEM

(71) Applicant: Zebra Technologies Corporation, Lincolnshire, IL (US)

(72) Inventors: Daniel E. Perry, Camarillo, CA (US); Stephen L. Ijams, San Jose, CA (US); Keath Jason Lawson Irizarry, Port Hueneme, CA (US); Robert D. Hunter, Camarillo, CA (US); Caleb J. Bryant, Moorpark, CA (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

(21) Appl. No.: 16/163,344

(22) Filed: Oct. 17, 2018

(65) Prior Publication Data

US 2019/0047305 A1 Feb. 14, 2019

Related U.S. Application Data

(63) Continuation of application No. 15/132,736, filed on Apr. 19, 2016, now Pat. No. 10,144,234, which is a continuation of application No. 13/296,096, filed on Nov. 14, 2011, now Pat. No. 9,346,294.

(60) Provisional application No. 61/413,890, filed on Nov. 15, 2010.

(51) Int. Cl.

| | |
|---|---|
| ***B41J 29/02*** | (2006.01) |
| ***B41J 17/24*** | (2006.01) |
| ***B41J 15/04*** | (2006.01) |

(52) U.S. Cl.
CPC ..... *B41J 29/02* (2013.01); *B41J 15/042* (2013.01); *B41J 17/24* (2013.01)

(58) Field of Classification Search
CPC ..... B41J 29/02; B41J 15/042; B41J 17/24
See application file for complete search history.

(56) References Cited

U.S. PATENT DOCUMENTS

| | | | | |
|---|---|---|---|---|
| 6,155,731 | A * | 12/2000 | Bertalan | B41J 11/703 101/227 |
| 6,252,619 | B1 * | 6/2001 | Ueda | G03G 21/1628 347/138 |
| 7,703,881 | B2 * | 4/2010 | Asada | B41J 17/32 347/171 |
| 2003/0002908 | A1 * | 1/2003 | Hirabayashi | B41J 11/06 400/649 |
| 2003/0086708 | A1 * | 5/2003 | Wang | G03B 17/26 396/512 |
| 2003/0128254 | A1 * | 7/2003 | Ison | B41J 2/14209 347/49 |
| 2004/0109715 | A1 * | 6/2004 | Meier | B41J 2/17546 400/191 |

(Continued)

*Primary Examiner* — David H Banh

(57) ABSTRACT

A printhead assembly structured to be removably received into a printhead guide of a media processing device having a platen and a biasing assembly, the printhead assembly comprising a printhead and a support body. The support body is adapted to support the printhead. The support body is structured to slidably translate within the printhead guide between a disengaged position, where the printhead is removed from the platen, and an engaged position, wherein the printhead is positioned proximate the platen. The support body defines an interface member structured to removably engage the biasing assembly.

16 Claims, 22 Drawing Sheets

(56) References Cited

U.S. PATENT DOCUMENTS

| | | | | |
|---|---|---|---|---|
| 2004/0114981 | A1* | 6/2004 | Meier | B41J 2/17546 400/208 |
| 2004/0131350 | A1* | 7/2004 | Wilson Wang | G03B 17/26 396/513 |
| 2005/0091338 | A1* | 4/2005 | de la Huerga | A61J 1/1437 709/217 |
| 2006/0071420 | A1* | 4/2006 | Meier | B65H 5/18 271/272 |
| 2006/0238562 | A1* | 10/2006 | Asada | B41J 17/32 347/33 |
| 2006/0273101 | A1* | 12/2006 | Lewis | A47K 10/422 221/56 |
| 2007/0172293 | A1* | 7/2007 | Vandermeulen | B41J 3/4075 400/615.2 |
| 2008/0252670 | A1* | 10/2008 | LaBar | B41J 2/1752 347/9 |
| 2009/0317161 | A1* | 12/2009 | Vo | B41J 17/32 400/207 |
| 2009/0322836 | A1* | 12/2009 | Kanbe | B41J 2/17513 347/86 |
| 2015/0165802 | A1* | 6/2015 | Wong | B41J 2/325 347/110 |
| 2017/0297330 | A1* | 10/2017 | De Groot | B41J 29/377 |

* cited by examiner

MEDIA PROCESSING DEVICE AND ASSOCIATED SYSTEM

CROSS REFERENCE TO RELATED APPLICATIONS

This patent arises from a continuation of U.S. patent application Ser. No. 15/132,736, filed Apr. 19, 2016, which is a continuation of U.S. patent application Ser. No. 13/296,096, filed Nov. 14, 2011, which claims the benefit of U.S. Provisional Patent Application Ser. No. 61/413,890, filed Nov. 15, 2010. U.S. patent application Ser. No. 15/132,736, U.S. patent application Ser. No. 13/296,096, and U.S. Provisional Patent Application Ser. No. 61/413,890 are each hereby incorporated herein by reference in their entireties.

TECHNOLOGICAL FIELD

Example embodiments of the present invention relate generally to a media processing device and systems associated therewith. In particular, embodiments relate to a media processing device having a consumable support assembly, a media feed module with an inertial brake, an isolated encoding assembly, a removable media cleaning assembly, and a printing station module including a consumable support assembly and a modular printhead. The modular printhead may include improved heat dissipation features such as a cooling air flow channel isolated from the printhead and a thermal interface material to more efficiently remove heat from the printhead.

BACKGROUND

Various embodiments of the invention are directed to printers and other systems for processing media including labels, receipt media, cards, and the like. Applicant has identified a number of deficiencies and problems associated with the manufacture, use, and maintenance of conventional media processing devices. Through applied effort, ingenuity, and innovation, Applicant has solved many of these identified problems by developing a solution that is embodied by the present invention, which is described in detail below.

SUMMARY

Various embodiments of the present invention are directed to a device and associated system for processing media (e.g., cards such as those used for driver's licenses, sheet media, labels, and the like). The term "media processing device" as used in the foregoing description refers to printers (e.g., thermal transfer, intermediate thermal transfer, direction thermal, etc.), laminators, magnetic stripe and/or RFID transponder encoders, and other devices that process, alter, modify, or render data and/or indicia to media.

Several embodiments are directed to assemblies, modules, and/or components that are used in improved media processing devices. For example, some embodiments provide a consumable support assembly configured to load a consumable supply spool and a consumable take-up spool into a media processing device. The consumable support assembly may include a consumable support body configured for manipulation by a user between an open position and a closed position. The consumable support assembly may also include a consumable supply spool cradle extending from the consumable support body, where the consumable supply spool cradle may be configured to support first and second ends of the consumable supply spool, and a consumable take-up support cradle extending from the consumable support body, where the consumable take-up support cradle may be configured to support first and second ends of the consumable take up spool. The consumable support assembly may also include a guide extension extending from the consumable support body that is structured to guide the consumable support body relative to the media processing device as the consumable support body is manipulated between the open position and the closed position.

The consumable supply support cradle may include a first support wall defining a first recess structured to receive and support a first end of the consumable supply spool and a second wall defining a second recess configured to support a second end of the consumable supply spool. The consumable take-up support cradle may include a first support wall defining a first recess structured to receive and support a first end of the consumable take-up spool and a second wall defining a second recess configured to support a second end of the consumable take-up spool. The consumable support body may include an air flow channel positioned generally between the consumable supply support cradle and the consumable take-up spool cradle.

The guide extension of the consumable support assembly may define a latch feature that is configurable between a latched position, where the consumable support assembly may not be detached from the media processing device, and an unlatched position, where the consumable support assembly may be detached from the media processing device. The consumable support assembly may include a biasing element structured to apply tension to a consumable web passing between the consumable supply spool and the consumable take-up spool.

Example embodiments of the present invention may include a media processing device configured to receive a consumable supply spool and a consumable take-up spool. The media processing device may include a housing defining a guide channel and a consumable support assembly. The consumable support assembly may include a consumable support body configured for manipulation by a user between an open position and a closed position, a consumable supply support cradle extending from the consumable support body, where the consumable supply support cradle is configured to support first and second ends of the consumable supply spool, and a consumable take-up support cradle extending from the consumable support body, where the consumable take-up support cradle is configured to support first and second ends of the consumable take-up spool. The consumable support assembly may further include a guide extension extending from the consumable support body that is received by the guide channel and structured to guide the consumable support body relative to the media processing device as the consumable support body is manipulated between the open position and the closed position.

Example embodiments of the media processing apparatus may include a consumable supply spindle structured to receive and support the consumable supply spool when the consumable support body is disposed in the closed position. The media processing device may also include a consumable take-up spindle structured to receive and support the consumable take-up spool when the consumable support body is disposed in the closed position. The consumable supply spindle and the consumable take-up spindle may each define a tapered receiving end for lifting the consumable supply spool and the consumable take-up spool from the consumable supply support cradle and the consumable take-up support cradle, respectively, as the consumable support body is manipulated from the open position to the closed position. A printhead assembly may be positioned between the consumable supply spool and the consumable take-up spool when the consumable support body is in the closed position. The printhead assembly may be movable between an engaged position and a disengaged position and biased in the disengaged position.

Media processing devices according to example embodiments of the present invention may also include a lid movable between an open position and a closed position. In the closed position, the lid may be configured to engage a consumable support assembly that is also in the closed position and the lid may preclude the consumable support assembly from being moved to the open position when the lid is in the closed position.

Example embodiments of the present invention may include a printhead assembly structured to be removably received into a printhead guide of a media processing device having a platen and a biasing assembly. The printhead assembly may include a printhead and a support body adapted to support the printhead, where the support body is structured to slidably translate within the printhead guide between a disengaged position, where the printhead is removed from the platen, and an engaged position, where the printhead is positioned proximate the platen, and where the support body defines an interface member structured to removably engage the biasing assembly.

The printhead biasing assembly may be structured to bias the support body in the disengaged position. The printhead assembly may also include a latch that is configurable between a latched position, where the printhead is maintained in the engaged position, and an unlatched position, where the printhead is free to move to the disengaged position. The latch mechanism may be biased toward the latched position. The support assembly may include a printhead carrier and a printhead bracket where the printhead bracket supports the printhead and is structured to be removably coupled to the printhead carrier. The media processing device may include a lid movable between an open position and a closed position, and where the printhead carrier defines a drive surface that is engaged by the lid to drive the support body against the bias of the biasing assembly to the engaged position as the lid transitions between the open position and the closed position. The lid may define a release button where, in response to the release button being depressed, the latch of the printhead assembly is moved to the unlatched position. This movement of the printhead assembly may also start to lift the lid.

The printhead of example embodiments may include a printhead interface disposed in electrical communication with the printhead, where the printhead interface is positioned to engage a controller interface of the media processing device when the support body is disposed in the engaged position. The printhead interface may be positioned to disengage from the controller interface of the media processing device when the support body is disposed in the disengaged position.

Example embodiments of the present invention may provide a media processing device including a consumable supply spindle defining a consumable supply spool receiving axis, a consumable take-up spindle defining a consumable take-up spool receiving axis, a lid that is structured to move between an open position and a closed position along a hinge axis which is generally perpendicular to at least one of the consumable supply spool receiving axis and the consumable take-up spool receiving axis, and a printhead assembly positioned between the consumable supply spindle and the consumable take-up spindle. The printhead assembly may be structured to move between a disengaged position and an engaged position along an engagement direction which is generally perpendicular to the hinge axis and at least one of the consumable supply spool receiving axis and the consumable take-up spool receiving axis. The lid may define a clam-shell structure.

Further embodiments of the present invention may provide a media processing device that includes a flow device structured to produce an air flow and a printhead assembly defining a duct and including a printhead disposed in thermal communication with a heat sink. The duct may include at least one flow directing surface that is structured to direct the air flow over the heat sink while at least partly isolating the air flow from the printhead. The flow device may be structured to direct air flow through a plenum where the printhead assembly is movable between an engaged position and a disengaged position, and where the duct is aligned with the plenum in the engaged position and misaligned with the plenum in the disengaged position. The media processing device may also include a second flow channel where the duct is aligned with the second flow channel and the plenum in the engaged position and misaligned with the exhaust flow channel and the plenum in the disengaged position.

Embodiments of the present invention may provide a media processing device including a media feed module adapted to feed a media substrate along a media feed path, a housing at least partially enclosing the media feed path, the housing defining a cleaning support guide channel, and a cleaning support assembly. The cleaning support assembly may include a cleaning support body configured for manipulation within the cleaning support channel between a cleaning position and a removal position and a pair of cleaning rollers supported by the cleaning support body, where the pair of cleaning rollers define a nip that is aligned with the media feed path in the cleaning position and is misaligned with the media feed path in the removal position. The pair of cleaning rollers may be accessible for removal when the cleaning support body is disposed in the removal position. Each of the cleaning rollers may define a cleaning roller core including opposing ends and the cleaning support body may be configured to support each of the pair of cleaning rollers proximate their respective opposing ends. The cleaning support guide channel may define a cleaning support guide axis and the media feed path may define a media feed axis, where the media feed axis is generally perpendicular to the cleaning support guide axis.

Example embodiments of the present invention may provide a printhead assembly structured to be removably received into a printhead guide of a media processing device having a platen and a platen biasing assembly. The printhead assembly may include a printhead defining a first side and a second side, a first thermally conductive element attached to the first side of the printhead, a second thermally conductive element attached to the second side of the printhead, a first thermal interface material disposed between the printhead and the first thermally conductive element, and a second thermal interface material disposed between the printhead and the second thermally conductive element. The first thermally conductive element may be a heat sink. The second thermally conductive element may be a bracket. The first thermal interface material may be the same as or different from the second thermal interface material.

Further example embodiments of the present invention may include a media feed module structured to feed a stack of media substrates, the media feed module including a pusher configured to apply a biasing force to the stack of media substrates and an inertial brake configured to inhibit application of the biasing force to the stack of media substrates. The inertial brake may include a plunger configured to frictionally engage a surface of the media feed module. The inertial brake may further include a spring configured to bias the plunger into engagement with the surface of the media feed module. The plunger may be substantially comprised of a first material and a surface of the plunger configured to engage the surface of the media feed module may comprise a second material that has a higher frictional coefficient than the first material. The pusher may be biased into engagement with the stack of media substrates by a constant force spring and the inertial brake may be configured to resist the biasing force.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 17:
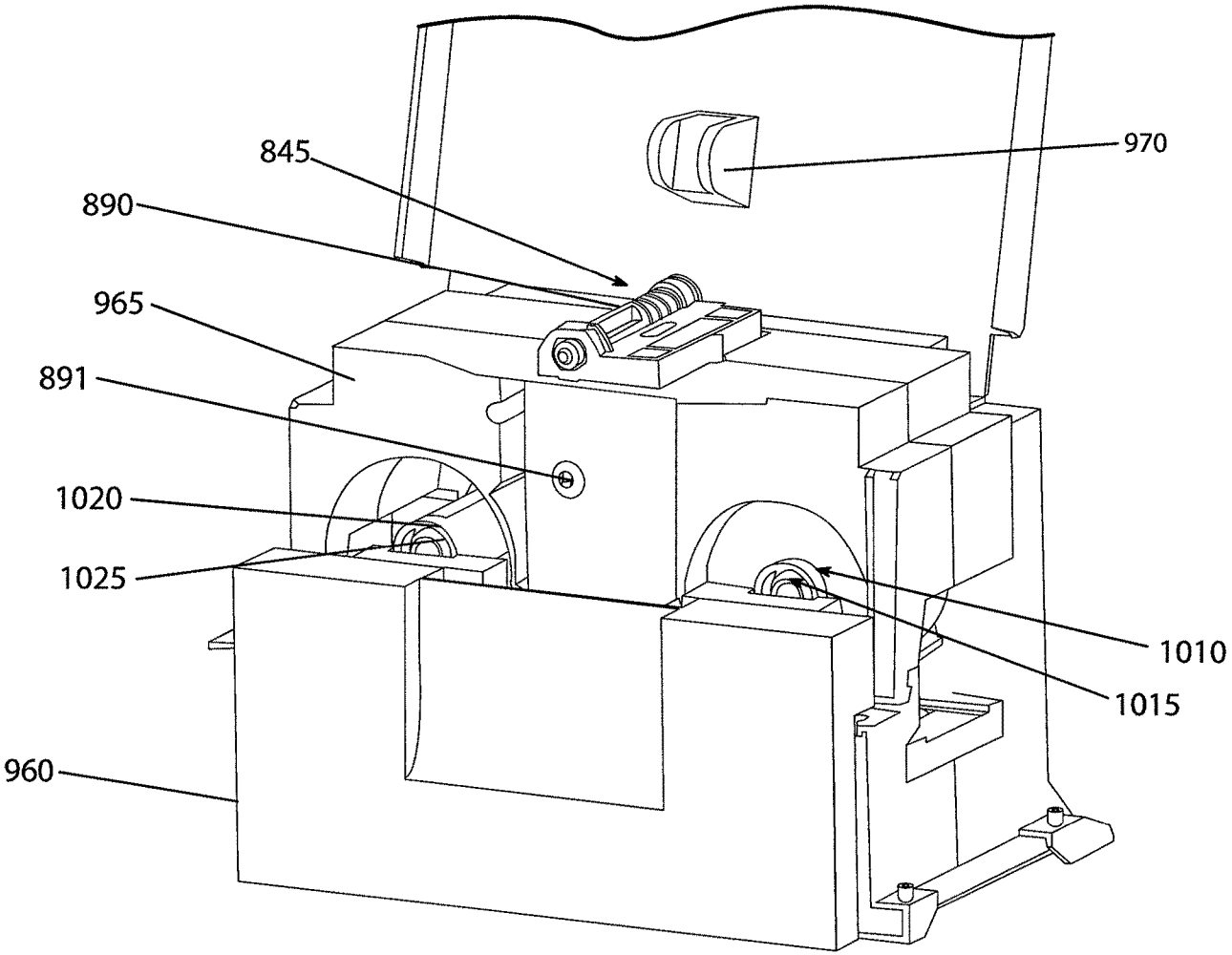
Figure 18:
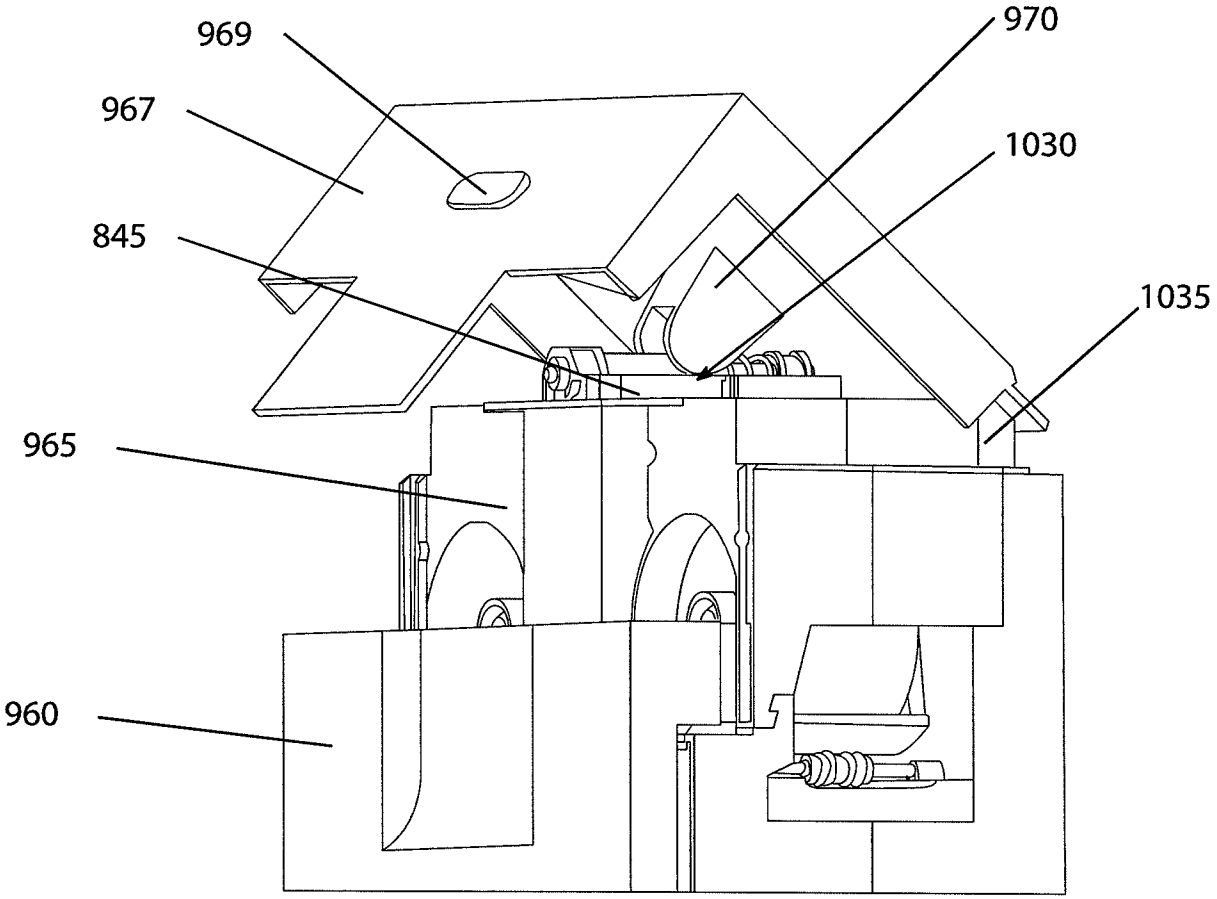

FIG. 17 illustrates a printing station module including a ribbon supply spool and a ribbon take-up spool arranged in a consumable support assembly which is disposed in a closed position according to an example embodiment of the present invention; and FIG. 18 illustrates a printing station module with a consumable support assembly in a closed position and a lid in a partially closed position according to an example embodiment of the present invention.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
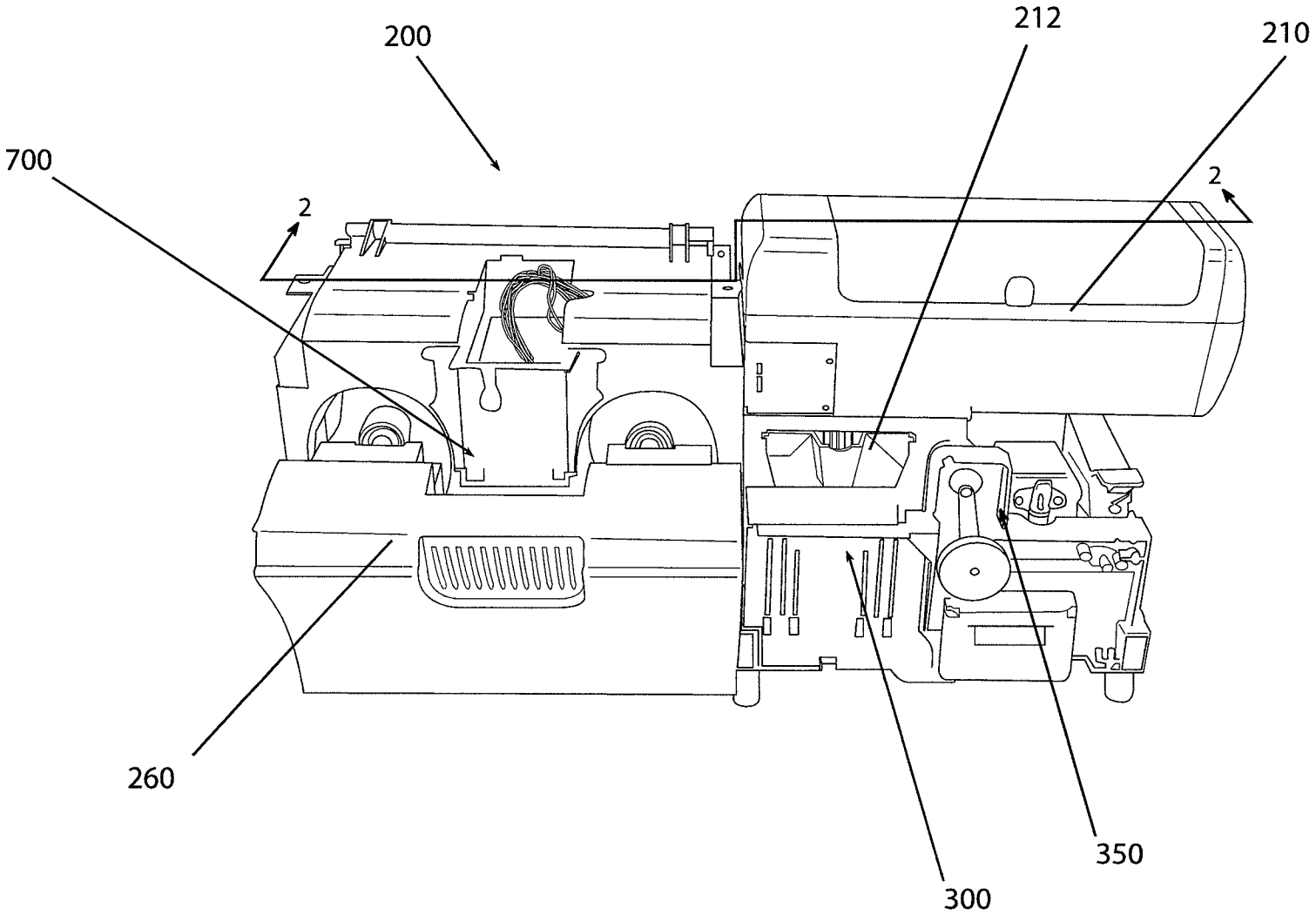
FIG. 1 depicts a modular media processing device including a media feed module according to an example embodiment of the present invention.
Figure 2:
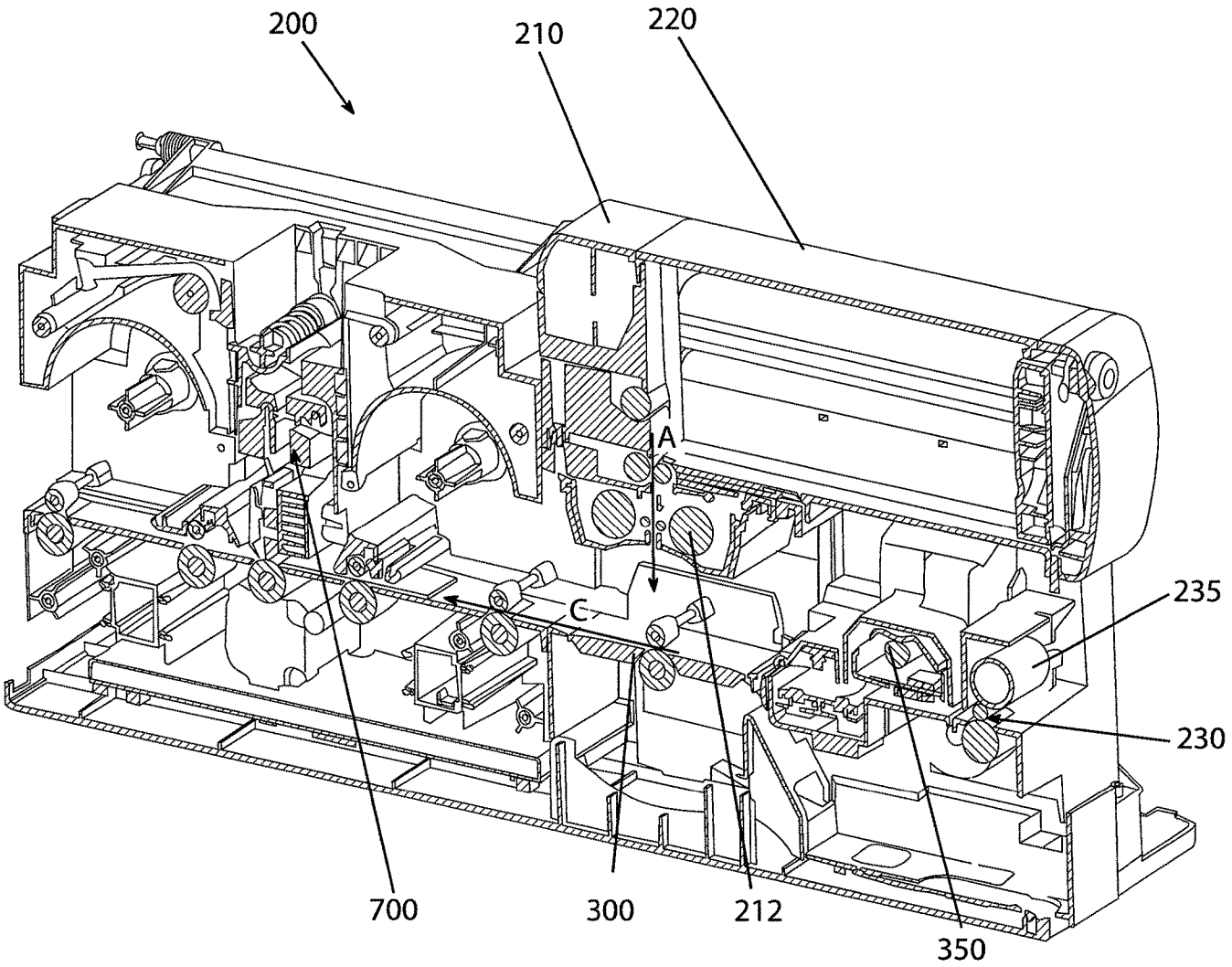
FIG. 2 depicts a section view of the modular media processing device of FIG. 1 taken along section line 2-2.

FIG. 1 depicts a media processing device 200 according to an example embodiment of the present invention, a cross section of which is illustrated in FIG. 2. The depicted media processing device is structured to process media such as rectangular media cards including PVC media cards that are commonly known in the art. In other embodiments, as will be apparent to one of ordinary skill in the art in view of the foregoing disclosure, the inventive concepts herein described may be applied to media processing devices configured to process various other types of media (e.g., labels, sheet media, radio frequency identification transponders, etc.). Thus, the disclosure provided herein may refer to an embodiment implementing media cards; however, any suitable media may be processed by example embodiments of the present invention.

The depicted media processing device 200 includes a media feed module 210 for storing a plurality of media substrates, such as a plurality of media cards, a media cleaning station 212, a media flipping station 300, and a media processing station 700. The media processing device may also include an encoding station 350 configured to encode a media substrate, such as encoding a magnetic stripe positioned on the back surface of a media card or an integrated circuit chip provided as part of an radio frequency identification ("RFID") transponder.

Referring now to FIG. 2, during processing operations, a media substrate may be drawn from the media feed module 210, through the cleaning station 212, and to the media flipping station 300. In the depicted embodiment, the media substrate is drawn downwardly to the flipping station 300 in a Y direction along arrow A. The flipping station 300, as will be further detailed below, then rotates the media substrate so that it may proceed in the X direction along arrow C to the processing station 700.

Conventional media cards (e.g., identification cards, credit cards, etc.) may include magnetic strips disposed longitudinally along one surface of the cards such that an encoder may be positioned along the media processing path to encode the magnetic stripe as the card is advanced along the processing path. In the illustrated embodiment, the media processing device may include an encoding station 350 disposed beneath the media feed module 210 and along the media processing path. A card may be directed from the media flipper 300, along the media feed path in the X direction, opposite arrow C, for an encoding operation at the encoding station 350 prior to being driven in the X direction along arrow C to the media processing station 700.

The media substrate may be received at media processing station 700 along the processing path whereupon the substrate may be processed. In the illustrated embodiment, the processing station may include a printing station module which includes an ink ribbon for printing an image on the surface of the substrate. Optionally, the media processing station may include an intermediate transfer station, a laminating station, an embossing station, or other form of media processing station. In the instant embodiment, the printing station module may include a ribbon supply spool and a ribbon take-up spool, between which resides a printhead that presses against a media substrate to transfer ink from the ribbon to the substrate to create indicia (e.g., an image, text, bar codes, etc.) on the substrate.

Media processing devices, such as printers, may be configured for specific uses (e.g., high-speed printing, single side printing, double sided printing, magnetic stripe encoding, radio frequency identification encoding, etc.). Customizing (i.e., specifically configuring) media processing devices at the point of manufacture for specific applications can result in a large number of media processing models being produced a manufacturer. This increases tooling cost, manufacturing and inventory costs, development, support, testing, and service parts related burdens. The additional costs involved result in a higher price tag for the end user.

Various embodiments of the present invention are directed to a media processing device configured to include interchangeable modules that increase manufacturing economies of scale and enhance media processing quality. Applicant has discovered that such modularity reduces repair costs as modular components may be interchanged without replacing or expensively modifying a previously customized media processing device. This modular approach further allows for scalability of a media processing device to add features and may permit independent parallel capabilities (e.g., printing and encoding). Individual module upgradability may be an additional benefit. Modules may include substrate manipulation stations (e.g., media flippers, media rotators), processing stations (e.g., laminators, encoders, printers, etc.), and material handling stations (e.g., feeder hoppers and output hoppers). While the term "card" is used herein to describe a type of media processed, other types of media may also be processed by apparatuses according to embodiments of the present invention. Cards may also include substrates with radio frequency identification tags disposed therein, magnetic stripes, embedded microchips, etc.

The modular architecture of media processing devices according to embodiments of the present invention may allow for customization of a processing device according to a customer's specific needs. For example, a customer may configure a media processing device with multiple printing modules and/or multiple processing options (such as laminating, encoding, etc.) tailored to their own specific needs. Customization may permit higher volume and faster processing speed for media as the processing device may be configured to only include the processing stations and components necessary for the customer's use. Extraneous processing operations may be omitted based upon the desired use.

Applicant has identified that a drawback with processing stations (printing, encoding, laminating, etc.) in conventional media processing devices may be that the processing stations are nested in the device and are very difficult to access, much less install or retrofit in the field (i.e., after manufacturing) as an upgrade. Often an entire media processing device will require significant disassembly to install such options, which can be time consuming, costly, and may lead to defects when reassembling or due to contamination of internal components. In addition, alignment of processing components may be compromised when a media processing device is torn-down and re-built in the field rather than on a purpose-built manufacturing assembly line where alignment can be held to higher tolerances. Further, in-line processing stations preclude simultaneous printing and encoding operations in most devices.

Media processing devices structured in accordance with various embodiments of the invention may use separate modules for each individual processing station with each module containing the necessary electro-mechanical components to perform the operations of the processing station. Optionally, modules may be capable of multiple processing operations, particularly in such embodiments where a compact media processing device is desirable. Such a modular media processing device may simplify upgrades and repair together with allowing a user to customize their device as their needs change. A modular media processing device may also permit parallel printing and encoding or other simultaneous processing operations on different media that may increase throughput.

FIGS. 1 and 2 depict a modular media processing device 200 structured in accordance with various embodiments of the present invention. The depicted media processing device includes various media processing modules including a media feed module 210, a media flipping module 300, a media encoding module 350, and a media printing module 700. Each of the depicted modules is described in greater detail below.

Figure 3:
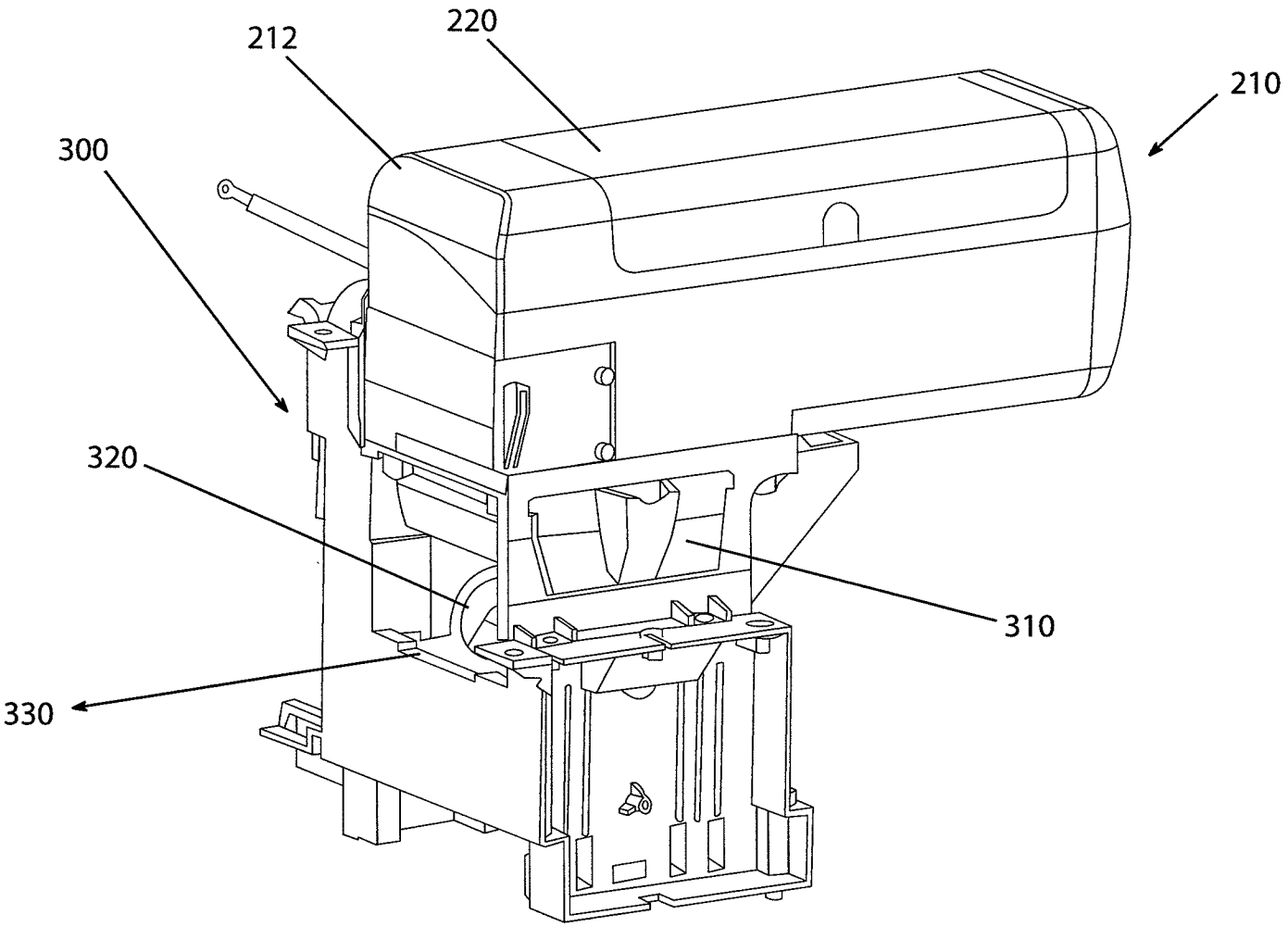
FIG. 3 illustrates a media feed module positioned above a media flipping module according to an example embodiment of the present invention.

FIG. 3 is a detail view of a media feed module structured in accordance with an example embodiment. Notably, the depicted media feed module 210 is structured to be removable and horizontally positioned when installed. The depicted media feed module 210 may increase throughput by ensuring a supply of cards or other media is available for the media processing device rather than relying upon individually fed media. Further, a removable media feed module 210 or magazine would allow multiple cartridges to be prepared for quick and easy replacement. Additionally, multiple cartridges may be kept on hand, each with a different type of media substrate in environments where multiple media substrates are used, whether the different types of substrates include different substrate materials, different sizes, different formats (e.g., magnetic stripe, RFID, etc.) or a combination thereof.

The media feed module 210 may include an access door 220 configured to provide access to the plurality of media substrates held therein while installed on the modular processing device 200. Permitting access to the plurality of media substrates may allow a user to re-load or replenish a media feed module 210 that is installed on a modular processing device while the device is processing media in order to reduce downtime that may be necessary to remove and reinstall a media feed module 210.

A manual feed slot 230 (shown in FIG. 2) may be implemented in addition to the media feed module 210 to allow, for example, for a small run of media that is different than those contained in the media feed module 210. The manual feed slot 230 may be used for re-processing of media or for specialty media which may not typically be printed in quantities that would merit batch feeding through a media feed module 210.

A cleaning support assembly 212 may be disposed at the exit of the media feed module 210 where media expelled from the media feed module is cleaned prior to being processed. In the illustrated embodiment of FIG. 2, the media processing device defines a housing that at least partially encloses the media feed path, identified by arrow C. The housing may further define a cleaning support guide channel that is generally perpendicular to the media feed path identified by arrow A. The cleaning support assembly 212 may be configured for manipulation between a cleaning position and a removal position along the cleaning support guide channel.

Figure 2A:
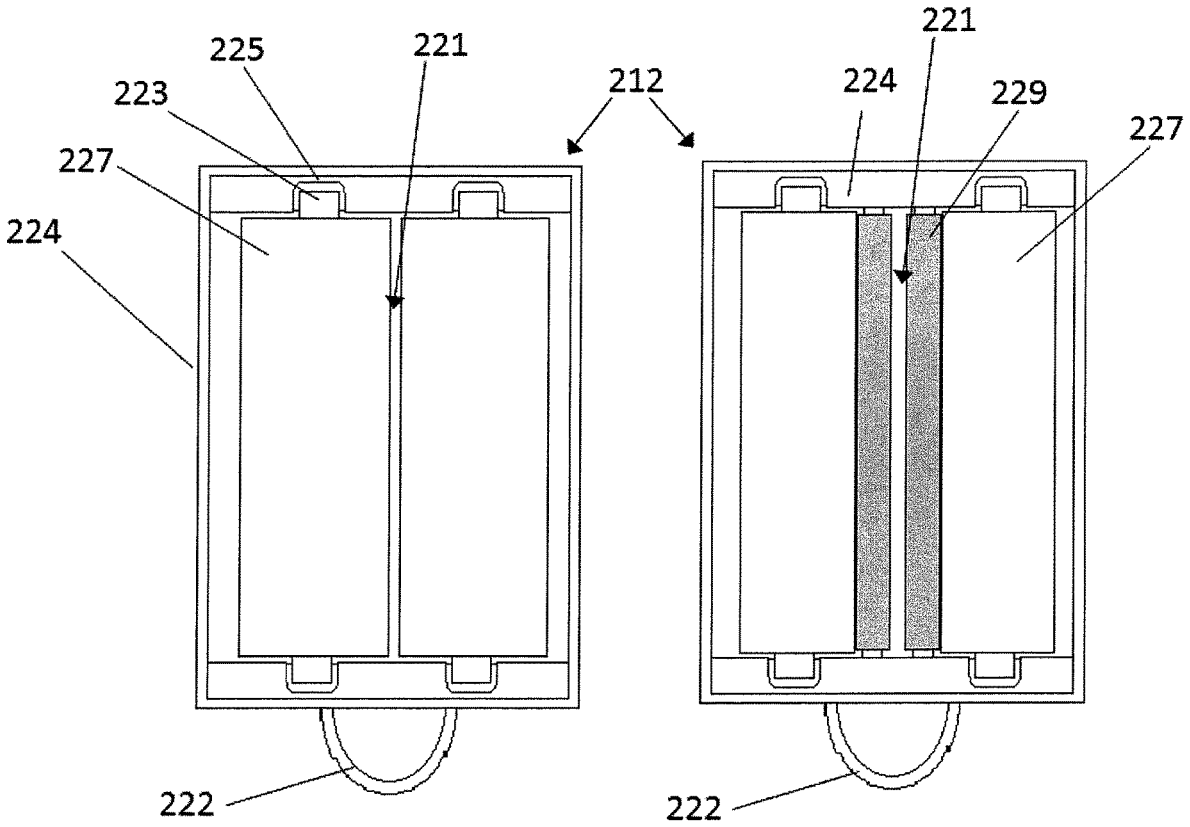
FIG. 2A depicts a top view of two embodiments of a cleaning support assembly according to example embodiments of the present invention.

FIG. 2A illustrates two example embodiments of a cleaning support assembly 212. The cleaning support assembly may include a cleaning support body 213 comprising a frame and a tab 222 which may be manipulated by a user to move the cleaning support assembly along the cleaning support guide between a cleaning position and a removal position. The cleaning support body may include a pair of cleaning rollers 227 removably supported by the cleaning support body 224. The cleaning rollers 227 may each include a core 223 which extends from opposing ends of the cleaning roller 227. The cleaning support body 224 may include recesses 225 in which the ends of the spool 223 are rotatably received.

The cleaning rollers 227 may each include a cleaning surface which may have adhesive properties and the cleaning rollers may define a nip 221 between them that is aligned with the media feed path A when the cleaning support assembly is in the cleaning position. When media passes through the nip 221 between the cleaning rollers 227, the cleaning rollers 227 contact the surface of the media while dust and debris from the media adheres to the cleaning rollers 227 and is removed from the surface of the media.

Optionally, the cleaning rollers 227 may not directly engage the media as it passes through the nip 221 of the cleaning support assembly, but a pair of intermediate rollers 229 may be disposed between the cleaning rollers 227 and the nip 221. The intermediate rollers may be permanently or removably mounted in the cleaning support body 224 and may be configured to transfer dust and debris from the surface of the media to a respective cleaning roller 227. In such an embodiment, the intermediate rollers may be made of a material with adhesive properties, such as a rubber, while the cleaning rollers 227 may include surface which has a higher level of adhesion.

When the cleaning support body 224 is moved to the removal position, the cleaning rollers 227 may be removable individually or as a pair. The nip 221 between the cleaning rollers 227 (or between the intermediate rollers 229) may be misaligned with the media feed path when the cleaning support body 224 is in the removal position.

Similarly, a cleaning support assembly 235 may be disposed at the manual feed slot 230 for cleaning media that is manually fed into the media processing device 200.

Figure 3A:
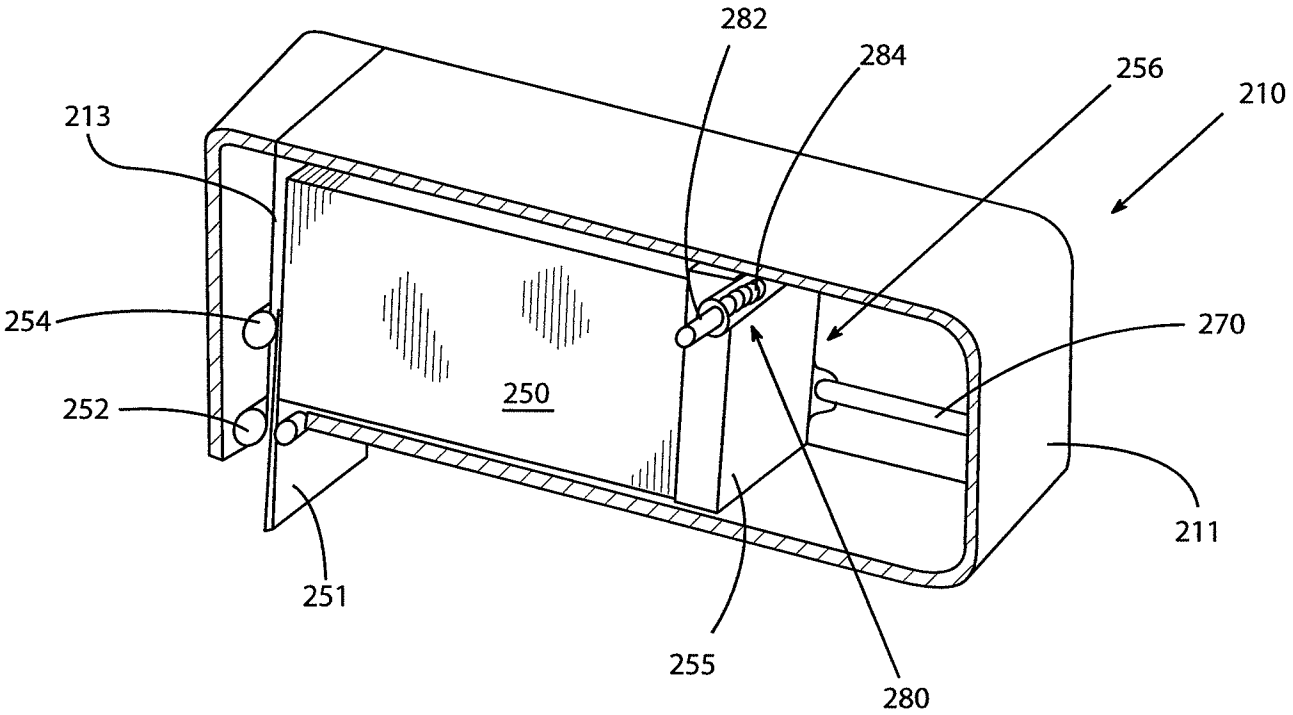
FIG. 3A illustrates a section view the media feed module of FIG. 2 including a media biasing assembly.

Example embodiments of a media feed module 210 may include a biasing assembly 256 to bias the media to one end of the cartridge and to maintain the media in the proper position to be received by the modular processing device 200 as illustrated in FIG. 3A. The depicted biasing assembly 256 includes a pusher 255 and a spring 270. The biasing assembly 256 urges the media substrate at the end of the stack into contact, or in a position to be contacted, by a pick roller 254 or other means by which the media is drawn from the media feed module.

In the illustrated embodiment, a stack of media substrates 250 is held upright and biased to a feed-end of the media feed module 210 by the pusher 255 of the media biasing assembly 256. The pick roller 254 is configured to contact the media substrate (here, a media card 251) at the end of the stack 250 and draw a single card 251 from the end of the stack along the media feed path. The pusher 255 of the media biasing assembly 256 may be biased in the direction of the stack of media 250 by a spring. In the illustrated embodiment, the spring 270 is disposed along the length of the side of the media feed module 210. In one embodiment the spring 270 is a constant force spring as is known in the art and is structured to provide a substantially constant pushing force against the stack of media 250. In other embodiments, the spring 270 may be disposed between the end of the housing 211 of the media feed module 210 and the pusher 255.

Applicant has discovered that a constant spring bias against the stack of media 250 may, in some circumstances, bind card 251 against the card wall 213 of the module 210 or otherwise inhibit drawing of the card 251 by the pick roller 254. In some circumstances, when a media substrate is slid off of the stack, the stack may become skewed when the media substrate is partially removed from the stack. For example, when the card 251 is drawn from a stack of cards 250 out of the bottom of the media feed module, as the card 251 is drawn, the top of the stack of cards is biased against the void left by the partially removed card 251 while the bottom of the stack 250 remains biased against the portion of the card 251 which has not yet been expelled. Such a difference may cause misalignment or skewing of the cards remaining in the stack 250 and may preclude the next card from being properly fed from the stack.

In view of the above, it may be desirable to regulate the biasing force exerted on the stack of media 250 by the pusher 255. An inertial brake 280 may be implemented to slow the movement of the pusher 255 in response to a media substrate 251 being drawn from the stack of media 250. The inertial brake 280 may include a plunger 282 that is configured to frictionally engage a surface within the media feed module 210. The plunger 282 may be biased into engagement with the surface within the media feed module by a biasing element such as a compression spring 284. The plunger may be made of any suitable material; however the end of the plunger 282 that engages the surface of the media feed module 210 may be of a material selected for the appropriate friction level desired between the surface and the plunger 282. For example, a rubber material may provide an appropriate amount of friction between the plunger 282 and the surface of the media feed module 210. The friction created may inhibit application of the biasing force by the pusher 255 (i.e., counteract the biasing force) when a media substrate is removed from the stack 250. By slowing the advancement of the pusher 255 toward the end of the stack 250, the likelihood of misalignment or skewing of the stack 250 may be reduced and the likelihood of a card 251 being inhibited from being drawn from the stack of media substrates 250.

Referring back to FIG. 3, an example embodiment of components of a modular processing device including a media feed module 210 positioned above a media flipping module 300 is illustrated. The media feed module 210 may be configured to dispense media from a proximal end 212, directing the media down along a path co-planar with a major surface of the media. The media substrate may be fed from the proximal end 212 of the media feed module 210, through a media cleaning station 310 as described above, to the media flipper 320 of the media flipping module 300. The media substrate fed from the media feed module 210 may enter the media flipper along a first feed path (arrow A of FIG. 2), which in the illustrated embodiment is substantially perpendicular to the media processing path 330 along which the media is processed. The media flipper 320 may receive the media along the media feed path, rotate the media along an axis transverse to the media processing path 330, and position the media to be expelled along the media processing path 330.

Figure 4:
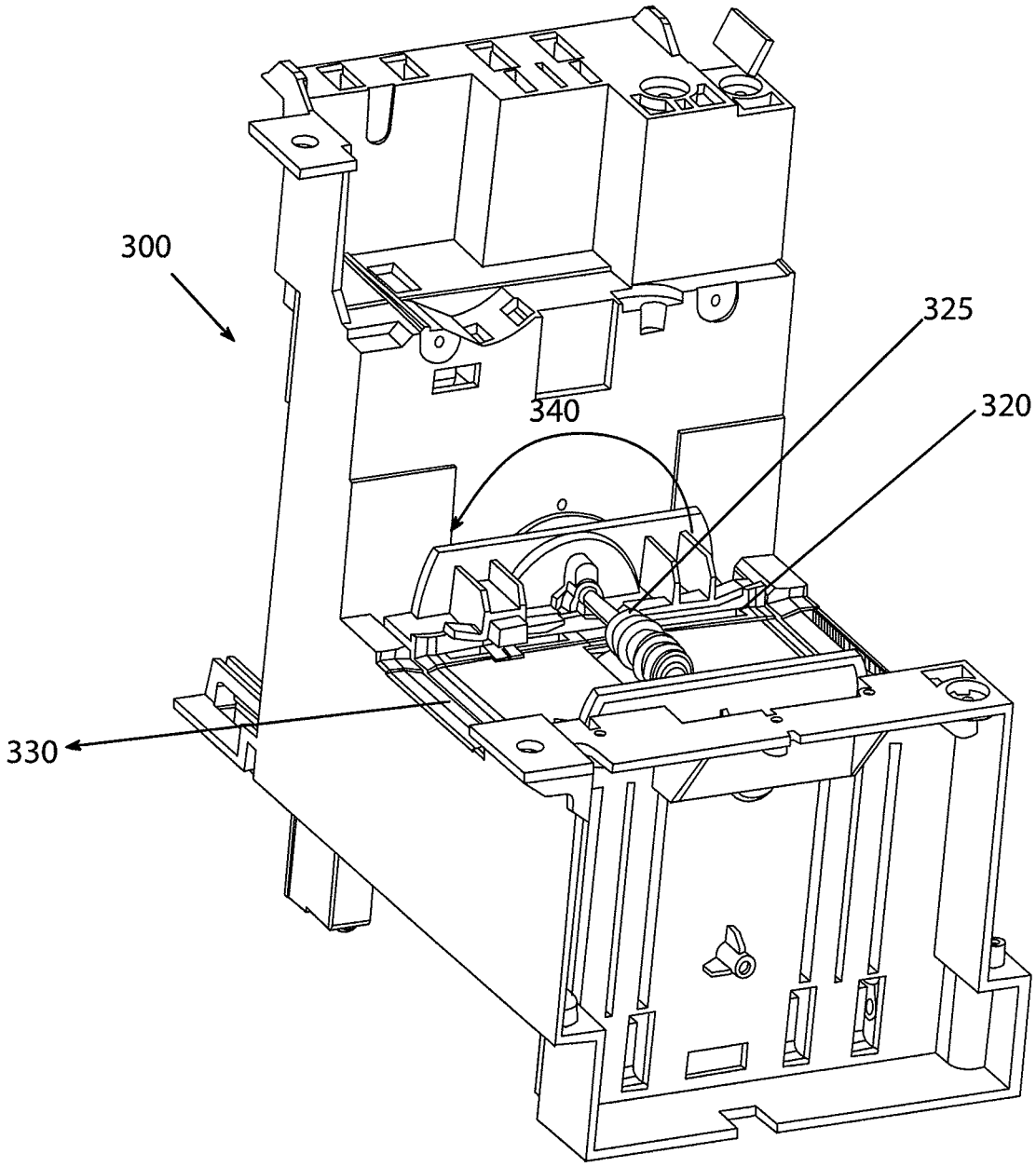
FIG. 4 illustrates a media flipping module according to an example embodiment of the present invention.

FIG. 4 illustrates an example embodiment of a media flipper module 300 according to the present invention. The media flipper 320 of the media flipper module 300 may rotate about an axis 325, along arrow 340, to a receiving position, in which the media flipper 320 is configured to receive a media substrate from a media feed module. Upon receipt of a media substrate from the media feed module 210, the media flipper 320 may rotate along arrow 340, or back against arrow 340, to place the media flat against the media processing path 330. The media may then be fed along the media processing path 330 to other processing modules. The media flipper 320 may further be used to re-direct the media along other processing paths as will be described further below.

Processing devices according to the present invention may further include an encoding module configured to encode a media substrate as it travels through the processing device. Encoding of media, and in particular, magnetic encoding of cards, is held to an ISO standard which includes a jitter specification. Jitter is a term commonly used for the mechanical disturbances on the encoding track during a write process and can be seen as power or data spikes or drop-outs when using encoding software. The spikes may appear in the encoded signature of a card such that the quality of the encoded card can be compromised by excessive jitter. If these spikes are too high, some magnetic encoder readers will fail to properly read the card. As such, it may be desirable to reduce jitter to improve the encoding quality such that any card encoded via the magnetic encoding operation will be readable with any reader.

Applicant has discovered that one source of excessive jitter is that the magnetic encoding head is often in-line with the mechanical drive components of the encoding device. The encoding path may be "daisy-chained" to the rest of the media processing device drive system via a gear drive or belt drive which may transmit excessive drive-line vibration to the encoding station. The magnetic encoding platen or other components of the magnetic encoder may resonate with the mechanical vibration of the other platens, belts, motors, gears, etc. in the chain and the vibration may cause jitter during the encoding process. Additionally, with in-line magnetic encoding, there exists only a single processing path such that only a single card can be processed at any given time which decreases throughput ability.

Isolating the encoding station may reduce or eliminate the mechanical disturbance (and therefore jitter) experienced by an encoding head. An isolated encoding station may draw the media from the processing path to a separate encoding path and may use a separate motor to drive the media along the encoding path to further reduce the likelihood of unnecessary vibration by isolating the encoding station from the remainder of the processing components. A media flipper or re-director may re-direct the media from the processing path to the isolated encoding path. The hardware supporting the encoding station is thereby isolated from the hardware driving the remaining processing stations and modules which may reduce the vibration and jitter experienced at the encoding station.

Figure 5:
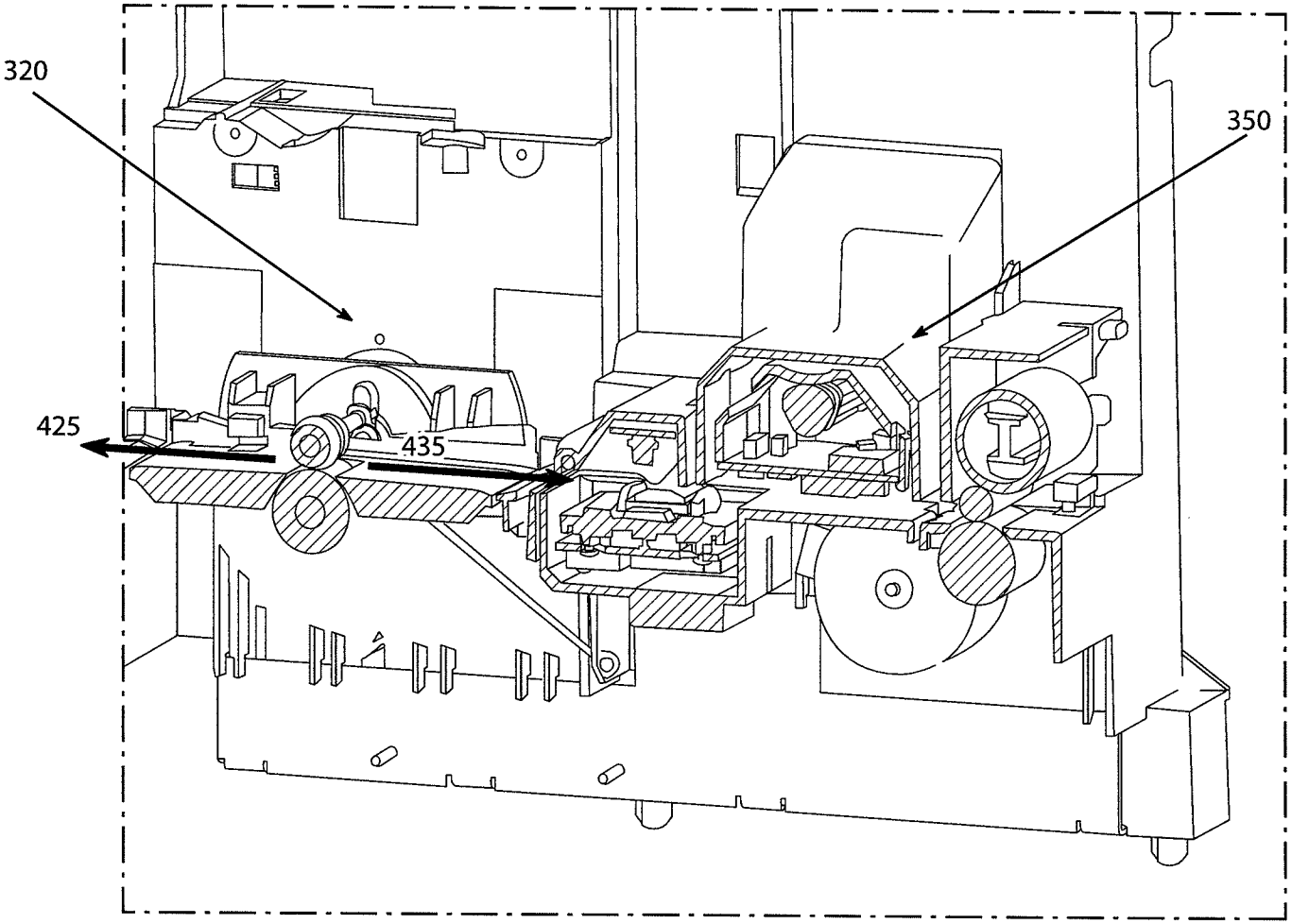
FIG. 5 illustrates a detail view of the isolated encoding station of the modular media processing device of FIG. 2.

FIG. 5 illustrates a detail view of the isolated encoding station 350 of the media processing device 400 of FIG. 2. The isolated encoding station 350 may be disposed within the media processing device 400 separated from other media processing operations or stations. A media substrate may be received from the media feed module 210 at media flipper 320 as described above. The media flipper 320 may be configured to direct the media along an encoding path 435, different from the media processing path 425, to the encoding station 350. Once the media substrate is encoded at the encoding station 350, the media may be driven back to the media flipper 320 such that the media flipper may flip or re-direct the media (if necessary) to the media processing path 425 for additional processing operations.

As noted above, the driving mechanism with which the media is driven to and from the encoding station 350 may be separate or otherwise isolated from the mechanism which drives media substrates along the media processing path 425 and retrieves the media from the media feed module 210. The isolation of the driving mechanism for the encoding may further improve the quality of the encoding by reducing jitter. In the depicted embodiment, the encoding path 435 is separated from the remainder of the processing path 425 by the media flipper 320 that receives media from the media feed module 210. Such an arrangement may allow the media flipper 320 to be used for both re-direction of media from the media feed module to the media processing path 425 and also to flip a media substrate on the processing path for processing of both sides of the media substrate. For example, a media substrate may require printing and encoding on the same side of the media substrate; however, the magnetic encoding head may be disposed under the encoding path while the printhead may be disposed above the processing path. The media flipper 320 may receive the media substrate after encoding and flip the media substrate 180 degrees such that the encoded side of the media may then be printed at the printing station module. Such an arrangement may reduce production costs of the media processing device 400 and may permit modular upgrades to existing devices.

Processing stations of media processing devices according to the present invention may include a printing station module configured to print on one or both faces of a media substrate. The printing station module may use a process of thermally transferring ink from a ribbon web substrate to a media substrate as the media substrate and ribbon web are fed between a printhead and a platen roller. The ribbon web may be supplied on a ribbon supply spool, and as the ink of the printer ribbon is consumed during the printing process, the used ribbon web is accumulated on a ribbon take-up spool. Upon depletion of the ribbon web from the supply spool, the ribbon must be replaced. To replace the ribbon web, the supply spool and the take-up spool must be removed from the printer and replaced with a new supply spool and take-up spool, which is loaded into the printing station module.

Ribbon loading and unloading in media printers has traditionally been difficult due to the need to feed the ribbon under the printhead and between ribbon sensors or other mechanisms. The difficulty in loading and unloading may be exacerbated when using large diameter ribbon as the ribbon web has to travel farther than with smaller diameter ribbons, and the use of large diameter ribbons may preclude the use of a convenient ribbon cartridge design. An improved method of loading and unloading a printer ribbon may include a consumable support assembly, such as a ribbon drawer, which is slid laterally out from a printer and thereby removes the ribbon from the printing mechanism in one smooth motion, parallel to the print line. Replacing the ribbon may be equally simple by inserting both the supply spool and take-up spool in respective receptacles within the consumable support assembly which, when seated, properly position the ribbon such that reinsertion of the consumable support assembly into the printer loads the ribbon with the correct alignment.

FIG. 5 illustrates a printing station module with a printhead 710 extending from a printhead guide 720 which is generally vertically disposed within a chassis 748. The printhead 710 is disposed between a consumable supply spool 730 and a consumable take-up spool 740. In the illustrated embodiment, the consumable supply spool 730 includes a ribbon supply spool and the consumable take-up spool 740 includes a ribbon take-up spool. The ribbon web is disposed along a ribbon path that extends from the supply spool 730, between the printhead 710 and the platen roller, to the take-up spool 740. The consumable support assembly is omitted from FIG. 5 for ease of understanding.

Figure 6:
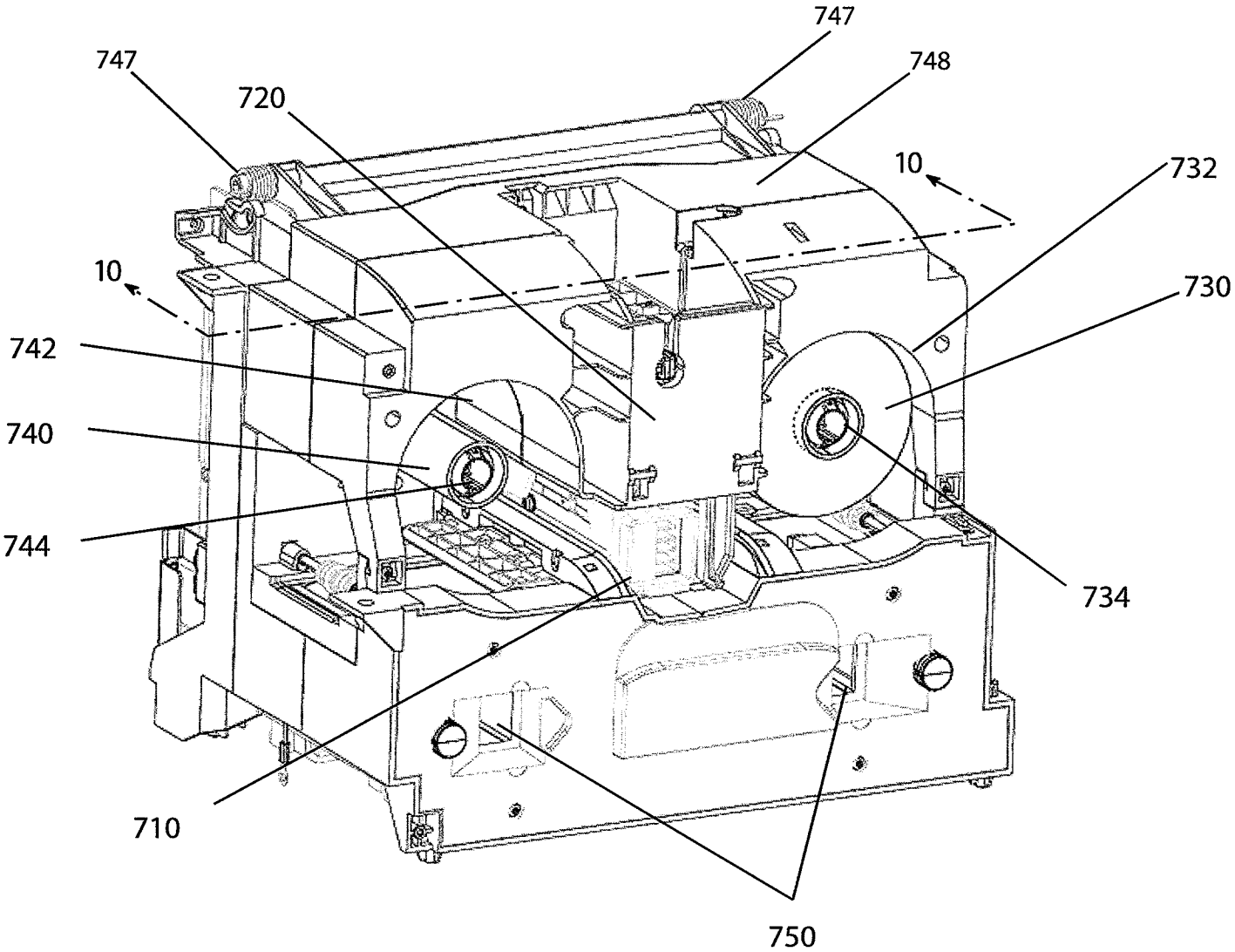
FIG. 6 illustrates a perspective view of a printing station module configured to receive a consumable support assembly according to an example embodiment of the present invention.

FIG. 6 depicts another example embodiment of a printing station module with the printhead 710 extending from the printhead guide 720. Disposed on a first side of the printhead guide is a recess 732 within the chassis 748 configured to receive the consumable supply spool 730 and disposed on a second side of the printhead guide 720 is a recess 742 within the chassis 748 configured to receive the consumable take-up spool 740. Further illustrated are a consumable supply spool spindle 734 and a consumable take-up spool spindle 744 on which the respective spools are received. The consumable supply spindle 740 defines a consumable supply spool receiving axis along the length of the consumable supply spindle 740 and the consumable take-up spindle 744 defines a consumable take-up spool receiving axis along the length of the consumable take-up spindle 744. As further detailed below, a lid may be attached to the printing station module with hinges 747 which define a hinge axis, which is substantially perpendicular to the consumable supply and take-up spool receiving axes. The printhead guide 720 is configured to guide the printhead assembly along an engagement direction, which is generally perpendicular to both the consumable supply and take-up spool receiving axes and the hinge axis. The printhead 710 of the illustrated embodiment is shown in an engaged position where the printhead 710 is in contact, or in near-contact with the platen roller, as will be discussed further below.

Figure 7:
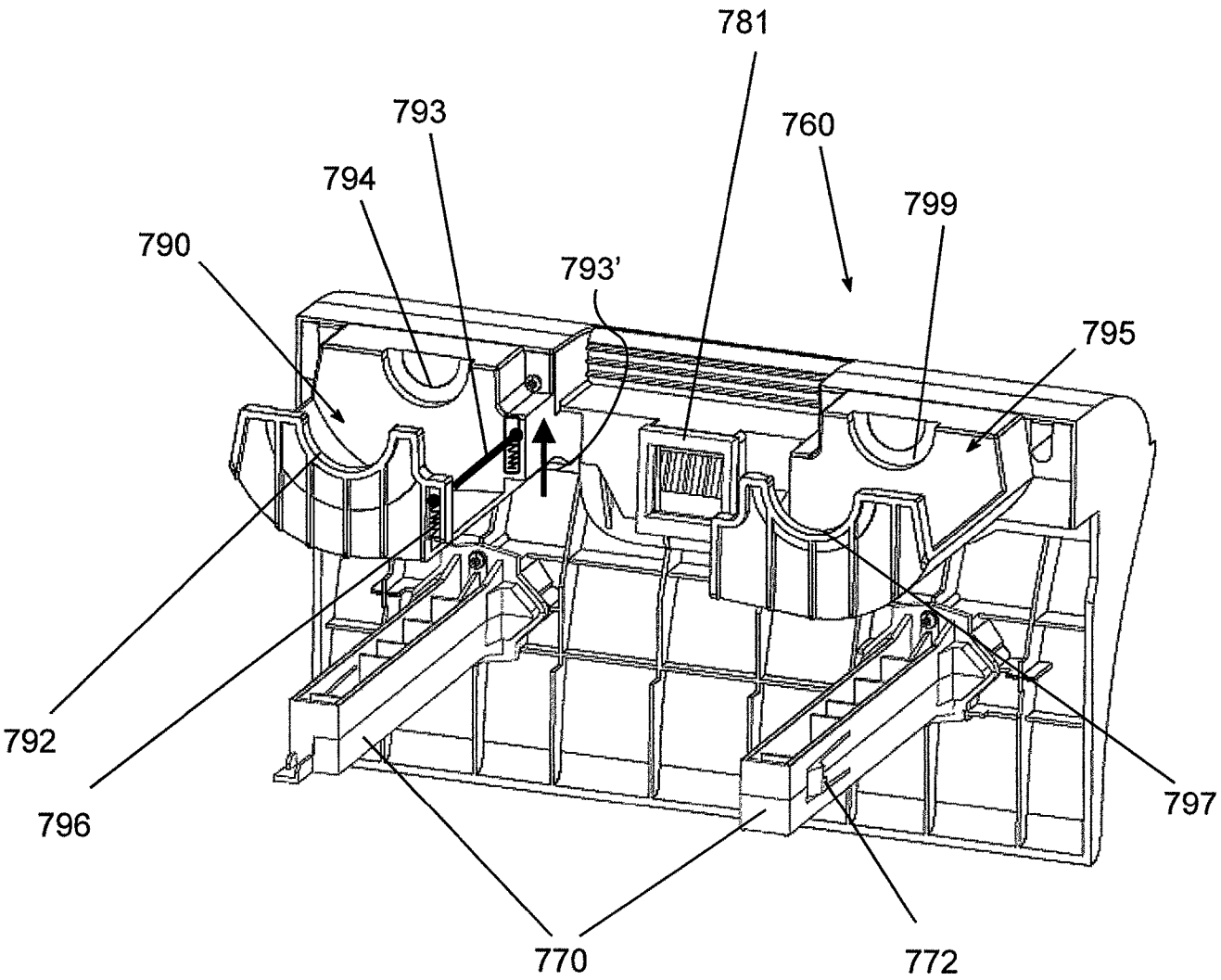
FIG. 7 illustrates an interior view of a consumable support assembly according to an example embodiment of the present invention.

The illustrated print station further includes guide channels 750 configured to receive guide extensions 770 of the consumable support assembly 760 (shown in FIG. 7). The guide channels are configured to align the consumable support assembly 760 and guide the consumable support assembly as it is moved between an open or "loading" position and a closed or "printing" position. In the printing position, the consumable support assembly is closed and the guide extensions 770 of the consumable support assembly are fully received within guide channels 750. In the loading position, the consumable support assembly 760 is open with the guide extensions 770 of the consumable support assembly either partially engaged in guide channels 750 or fully disengaged from the guide channels. Optionally, the consumable support assembly guide extensions 770 may include a latch 772 or other mechanism which may engage the guide channels 750 of the print station to preclude the consumable support assembly 760 extensions 770 from being fully disengaged from guide channels 750. Such a latch 772 may be desirable to prevent accidental removal of the consumable support assembly 760 from the printing station. The latch 772 may be depressed or otherwise overcome to remove the consumable support assembly 760 from the printing station module for cleaning or other purposes.

The consumable support assembly 760 of FIG. 7 further includes a consumable supply spool cradle 790 and a consumable take-up spool cradle 795. The consumable supply spool cradle 790 may be configured to receive a consumable supply spool while the consumable take-up spool cradle 795 may be configured to receive a consumable take-up spool. The consumable supply spool (and the consumable take-up spool) may include a consumable web wound around a ribbon core. The consumable supply spool core of the consumable supply spool 730 may be received on a spindle 734 as illustrated in FIG. 6. Similarly, the consumable take-up spool 740 may include a consumable take-up spool core which is received on the consumable take-up spindle 744. The consumable supply spool cradle 790 may further include recesses 792 and 794 configured to receive the consumable supply spool core to support the consumable supply spool in a loading position. The recesses 792, 794 of the consumable supply spool cradle 790 are configured to support first and second ends of the consumable supply spool core.

As the consumable supply spool cradle 790 and the consumable support assembly guide extensions 770 are in fixed alignment, upon closing of the consumable support assembly 760 to the printing station module, the consumable supply spool cradle 790 is aligned with the consumable supply spool recess 732. Alignment between the consumable supply spool cradle 790 and the consumable supply spool recess 732 further ensures alignment between a consumable supply spool core (supported by the consumable supply spool cradle recesses 792 and 794) and the consumable supply spool spindle 734, as shown in FIG. 6.

Similarly, with respect to the consumable take-up spool 740, the consumable take-up spool cradle 795 and the respective recesses 797 and 799 serve to align the consumable take-up spool core with the consumable take-up spindle 744. The consumable take-up spool recesses 797 and 799 being configured to support first and second ends of the consumable take-up spool. This configuration allows both the consumable supply spool and the take-up spool to be aligned and inserted on their respective spindles substantially simultaneously and repeatably.

Further, the consumable supply spindles and the consumable take-up spindles may be configured to raise the consumable supply spool core and the consumable take-up spool core out of their respective recesses as the consumable support assembly is closed to the printing station. Elevating the consumable cores from the consumable support cradles of the consumable support assembly may reduce wear between surfaces and may reduce the rotational friction required to be overcome to feed the consumable web from the consumable supply spool. The consumable spindles may lift the consumable cores from the consumable support assembly by virtue of their shape (e.g., a tapered leading edge or receiving end) or by their angle relative to the consumable support assembly.

FIG. 7 further illustrates a biasing element 793 configured to apply pressure to the consumable web disposed between the consumable supply spool 730 and the consumable take-up spool 740. The biasing element 793 may be biased in the direction of arrow 793' with a biasing mechanism, such as springs 796. The biasing element 793 may be configured to position the consumable web and maintain tension on the consumable web during the installation process, when the consumable support assembly is closed to the printing station.

Figure 8:
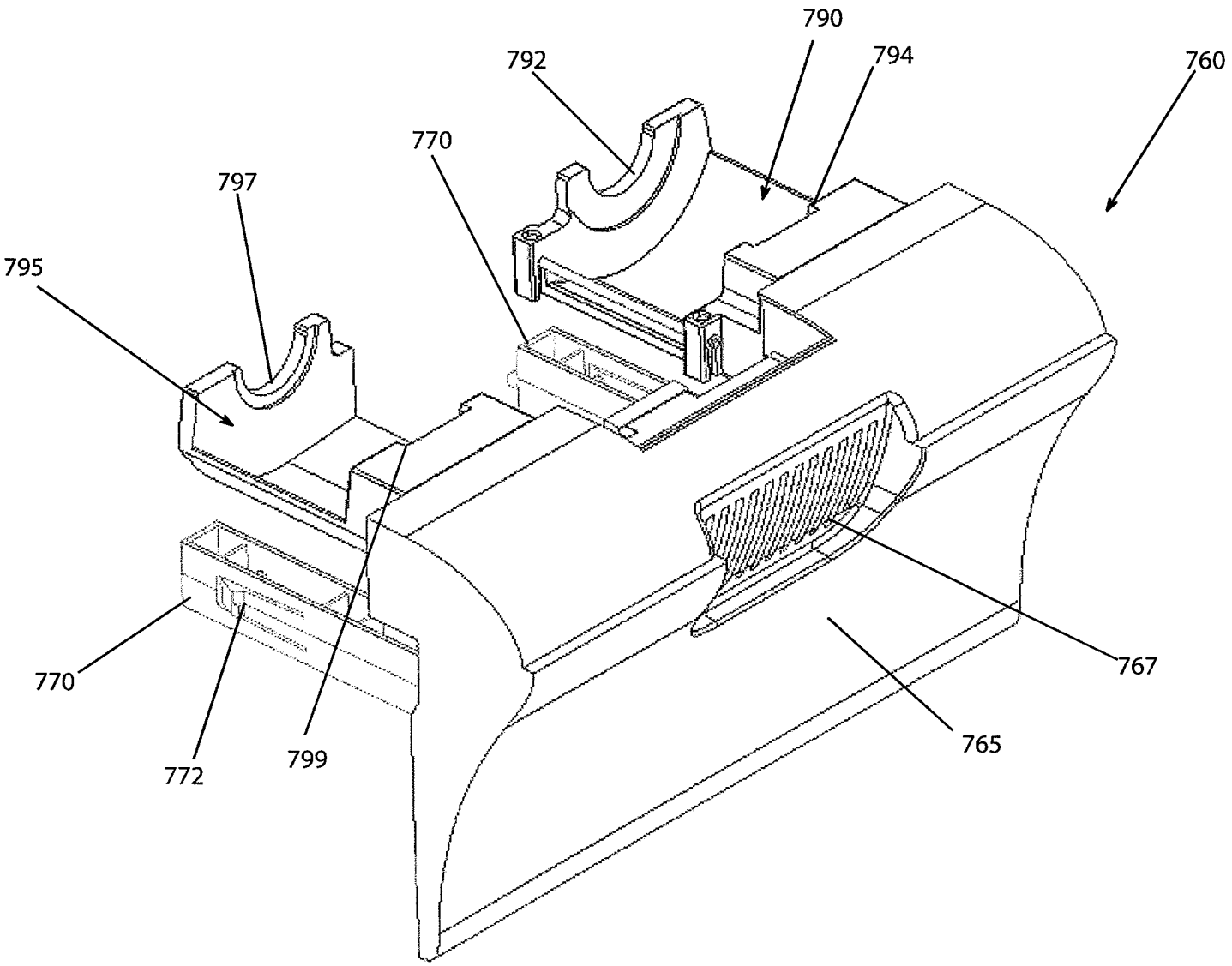
FIG. 8 illustrates an exterior perspective view of the consumable support assembly according to the example embodiment of FIG. 7.

FIG. 8 illustrates another view of the consumable support assembly 760 of FIG. 7. As illustrated, the consumable support body 765 of the consumable support assembly 760 may be configured for an aesthetically pleasing ornamental appearance of the exterior of the printer station and may be configured with a recess to aid a user in opening the consumable support assembly.

Further illustrated in FIG. 7 is an air-flow channel 781 configured to guide cooling air flow to or from the printhead as will be described further below. The air-flow channel 781 comprises a port which engages a duct of the printhead where the port is in fluid communication with the exterior of the media processing device when the consumable support assembly is in the closed position. The fluid communication between the printhead and the exterior of the media processing device permits cooling air to flow across the printhead and exit the media processing device.

While the consumable support assembly has been herein described and illustrated with respect to supporting and aiding the loading of an ink ribbon as the consumable, a similar apparatus may be used to support and aid the loading of other consumables, such as a spool of media, laminating material, holographic material, intermediate transfer media, etc.

As shown with respect to FIG. 6, the printhead 710 is disposed within printhead guide 720. The printhead guide 720 aids alignment of the printhead 710 with the platen roller which is disposed on the media processing path. As noted above with regard to the loading and unloading of ribbon, one drawback of conventional printing systems is that the ribbon web must be threaded between the nip defined by the printhead and the platen roller during print ribbon loading. Embodiments of the present invention provide a mechanism by which the printhead is separated from the platen roller for loading of a print ribbon to provide additional room in which the printer ribbon may be loaded.

Figure 9:
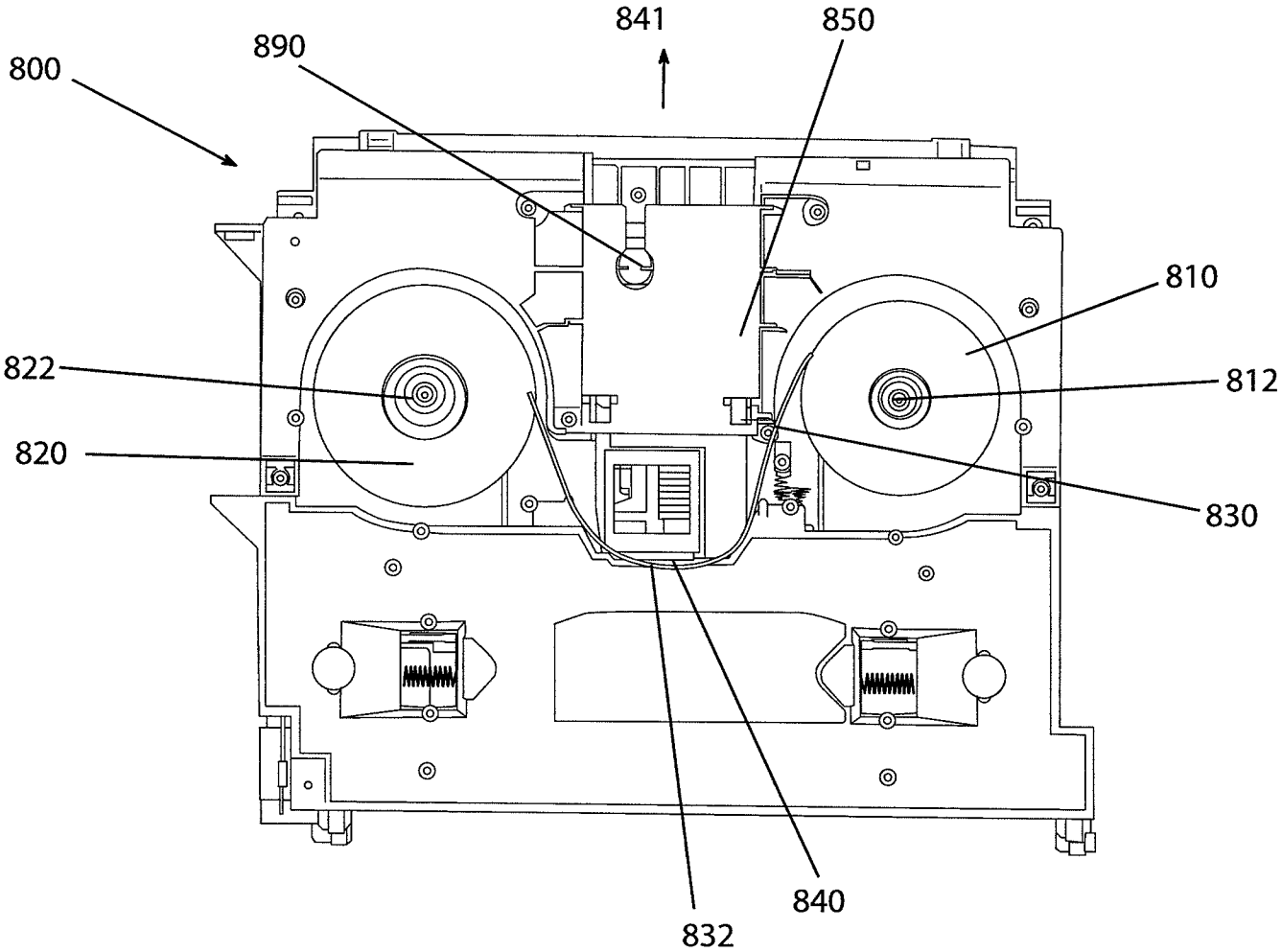
FIG. 9 illustrates a printing station module including a ribbon supply spool, a ribbon take-up spool, and a ribbon path defined there between, according to an example embodiment of the present invention.

FIG. 9 depicts a front view of a printing station module with the consumable support assembly omitted for ease of understanding. The depicted printing station module 800 includes a ribbon supply spindle 812 with a ribbon supply spool 810 and a take-up spindle 822 with a ribbon take-up spool 820. The ribbon web 830, between the ribbon supply spool 810 and the ribbon take-up spool 820, defines a ribbon path 832. The ribbon path begins at the ribbon supply spool 810, passes between the printhead 840 and the platen roller (not shown) and proceeds to the ribbon take-up spool 820. The illustrated embodiment depicts the printhead 840 in an engaged position with the platen roller such that the printhead is in a position to commence printing operations. As shown, the ribbon path 832 is narrow between the printhead 840 and the platen roller such that insertion of the ribbon between the printhead and the platen roller for loading of a ribbon web may be difficult.

The printhead 840 is illustrated in the engaged position; however, the printhead may be biased in a disengaged position, where the printhead 840 is biased in the direction of arrow 841. The biasing mechanism may include a spring or deformable member which drives the printhead 840 along arrow 841 within the printhead guide 850. When the printhead 840 is in the disengaged position (i.e., raised from the platen along arrow 841), the ribbon web 830 may be afforded a greater space between the printhead 840 and the platen to ease installation.

Figure 10:
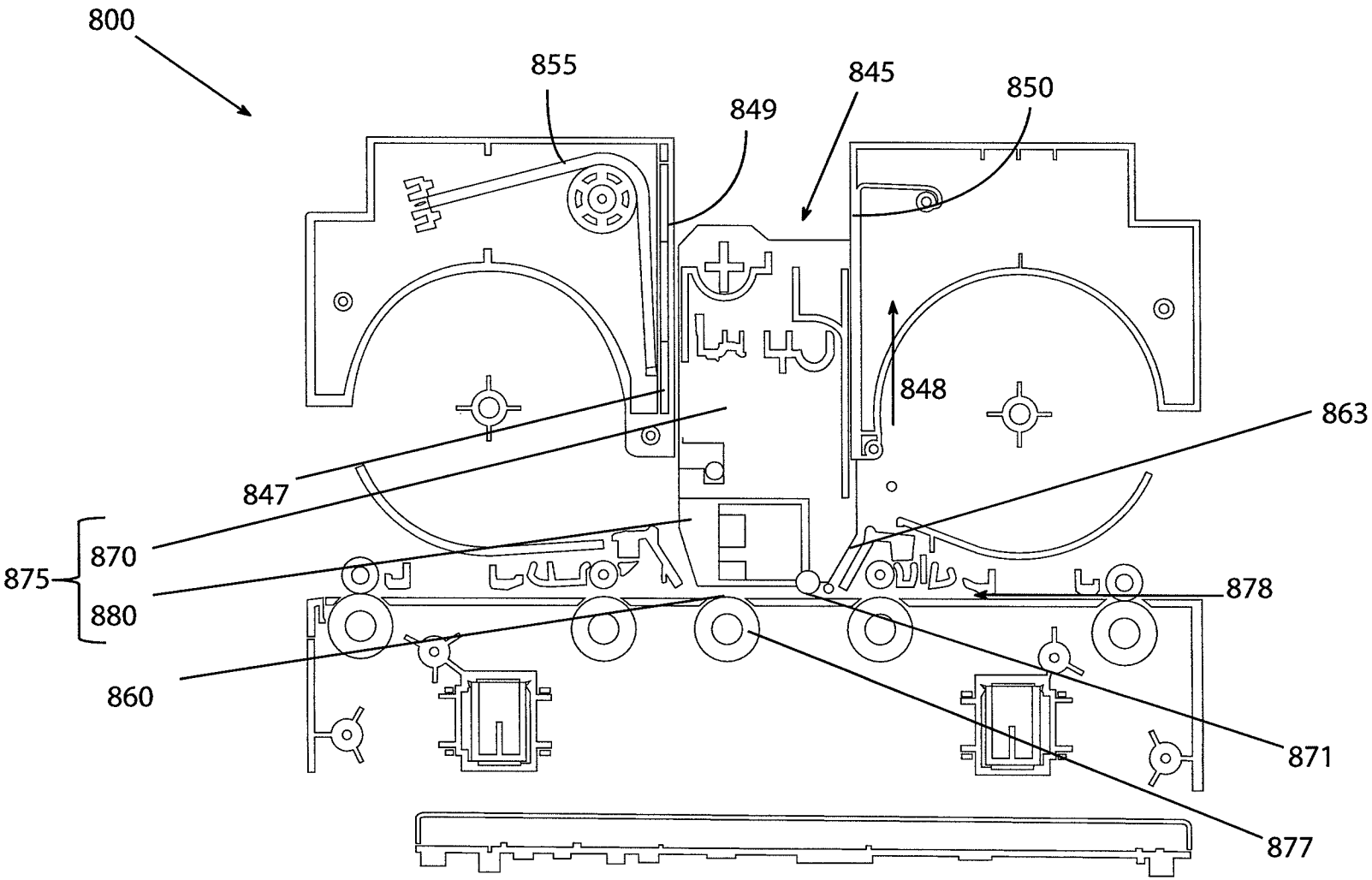
FIG. 10 illustrates an example embodiment of a printhead assembly received within a printhead guide taken along section line 10-10 of FIG. 6 according to the present invention.

FIG. 10 illustrates an example embodiment of a biasing mechanism which may be used in printing stations according to the present invention taken along section line 10-10 of FIG. 6. The illustrated embodiment includes a printhead assembly 845 disposed within a channel formed by the printhead guide 850 of FIG. 9. The printhead assembly 845 may be configured to ride within this channel in a substantially linear fashion where alignment of the printhead and the platen is maintained during routine cycles of engagement and disengagement. The printhead assembly 845 may include a support body 875 which includes a printhead carrier 870 and a printhead bracket 880. The support body 875 of the printhead assembly 845 may engage a biasing assembly of the printing station to bias the support body 875 toward the disengaged position, along arrow 848.

As illustrated, the biasing assembly may include a carrier 847 which may be disposed within a track 849 of the channel of the printhead guide 850. The carrier 847 may be coupled to a biasing element, such as spring 855, which biases the carrier 847 upwardly, along arrow 848. The carrier 847 may be disposed within a track 849 to limit the movement of the carrier to a single degree of freedom and enabling the printhead assembly 845 to be indirectly coupled to the biasing assembly, allowing the printhead assembly 845 to be removed from the printhead guide 850 without requiring the biasing assembly to be un-coupled from the printhead assembly 845 as described further below. The carrier 847 may include a tab (not shown) structured to engage an interface member (not shown), such as a recess, of the printhead support body 875; however, the biasing assembly, and in particular, the carrier 847, may engage the support body 875 through any means which permits the interface member to exert a biasing force on the support body 875 in the direction of arrow 848 while not including a permanent coupling (i.e., the carrier 847 may be readily engaged and disengaged from the interface member). For example, the support body 875 may include a tab which engages a recess or otherwise engages the carrier 847.

While the depicted embodiment illustrates a printhead assembly 845 configured to move between an engaged position and a disengaged position along a linear path that is defined by the printhead guide 850, it is appreciated that other mechanisms may be used to establish the linear path of the printhead assembly 845. For example, the printhead assembly 845 may be configured with a channel through which a rail is configured to pass. The rail may guide the printhead assembly 845 along a linear path and preclude rotation, effecting the same alignment function of the printhead guide 850 illustrated.

Figure 11:
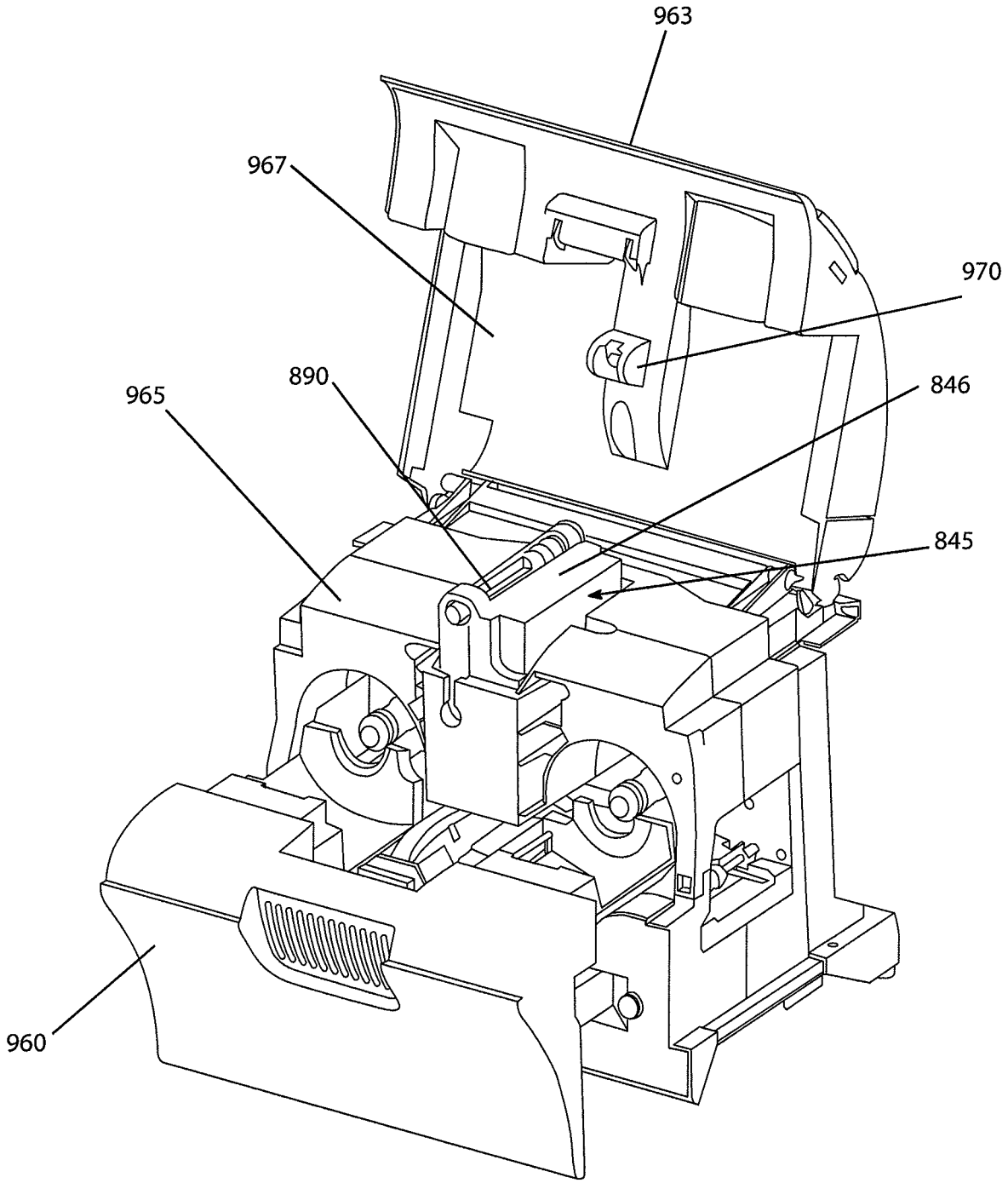
FIG. 11 illustrates a printing station module including a lid and a consumable support assembly, each disposed in an open position, according to an example embodiment of the present invention.
Figure 12:
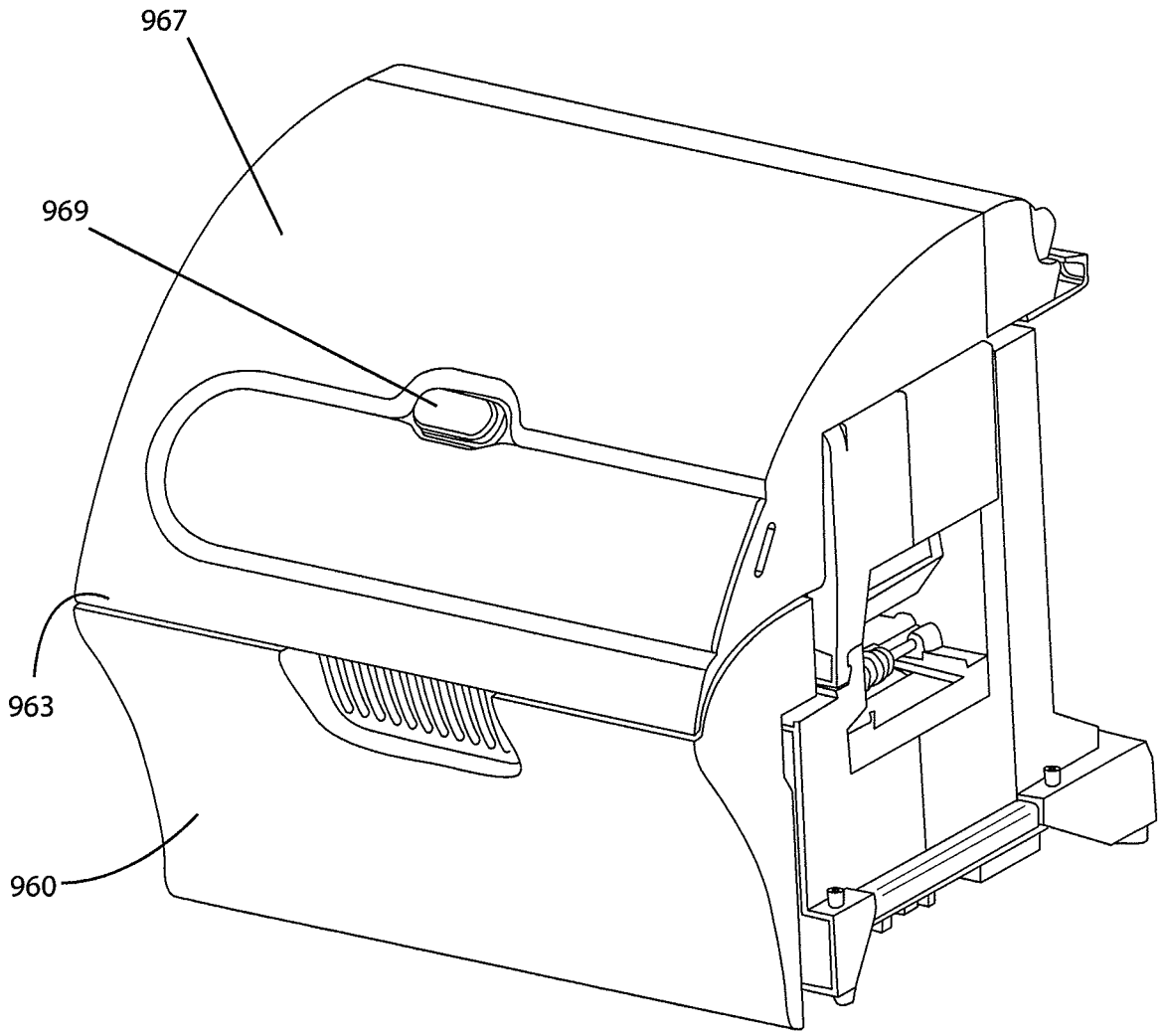
FIG. 12 illustrates the printing station module of FIG. 11 with the lid and consumable support assembly each disposed in a closed position.

FIG. 11 illustrates an example embodiment of a printing station module comprising a consumable support assembly 960 and a printing station housing 965. The printing station housing 965 further comprises a lid 967 hingedly coupled to the print station housing 965 and configured to close over the printing station. The lid 967 may protect the printing station from environmental contaminants and preclude interference from a user. The lid 967 may include a bull-nose feature 970 disposed on the inside thereof. The bull-nose feature 970 may be configured to engage a drive surface 846 of the printhead assembly 845 as will be described in detail below. The lid 967 may further comprise a tab 963 where the tab is configured to engage the consumable support assembly 960 when both the lid 967 and the consumable support assembly 960 are in the closed configuration (as shown in FIG. 12). The tab 963 may be configured to preclude opening of the consumable support assembly 960 while the lid 967 is in the closed position, thereby requiring the lid to be opened prior to opening the consumable support assembly 960.

Upon closing of the lid 967, the bull-nose feature 970 of the lid may be configured to engage the drive surface 846 of the printhead assembly 845 of the printing station module. The bull-nose feature 970 may be configured to drive the printhead assembly 845 against the biasing mechanism, into the printhead guide 850, toward the engaged position illustrated in FIG. 9. The bull-nose 970 may be configured such that when the lid 967 is fully closed, the printhead assembly 845 is in the engaged position. The lid 967 may be secured in the closed position by a latch or other mechanism thereby holding the printhead assembly 845 in the engaged position. A release button 969 may be provided to release the lid 967 from the closed position to provide access to the printing station module components.

The printhead assembly 845 may also be removable from the printhead guide 850 by sliding the printhead assembly 845 in the direction of arrow 841 of FIG. 9. Removal of the printhead assembly 845 may require the disconnection of a hardwired connection; however, the printhead 840 may be configured such that electrical connection between a printhead controller and the printhead is established upon moving the printhead assembly 845 to the engaged position. In such an embodiment, a separate hardwire connection between the printhead 840 and the printing station module may not be necessary. As such, it may be possible to remove the printhead assembly 845 from the printing station in a single movement (i.e., not requiring the disconnection of electrical cables or tools) in response to the printhead assembly 845 being in the disengaged position.

An electrical interface between the printhead 840 of the printhead assembly 845 and the media processing device 800 may be established at an interface such as interface 863 of FIG. 10 such that when the printhead assembly 845 is in the illustrated, engaged position, electrical communication is established between the printhead 840 and the media processing device 800 (e.g., printhead interface of the printhead 840 establishing electrical communication with a controller interface of the media processing device 800). The printhead interface may include electrical contacts or pins while the controller interface may include complementary electrical contacts or pins to engage the printhead interface. The electrical interface between the printhead 840 and the media processing device 800 may be configured to communicate power and printing information or data between the printer controller and the printhead 840 for printing indicia on a media substrate. Further, a physical electrical connection may not be necessary as communication between the printhead 840 and the media processing device may be established through near-field communications, such as through radio frequency or Bluetooth®. Power to the printhead 840 may be established through an inductive field thereby eliminating the need for a physical electrical communication between the printhead 840 and the media processing device.

Figure 13:
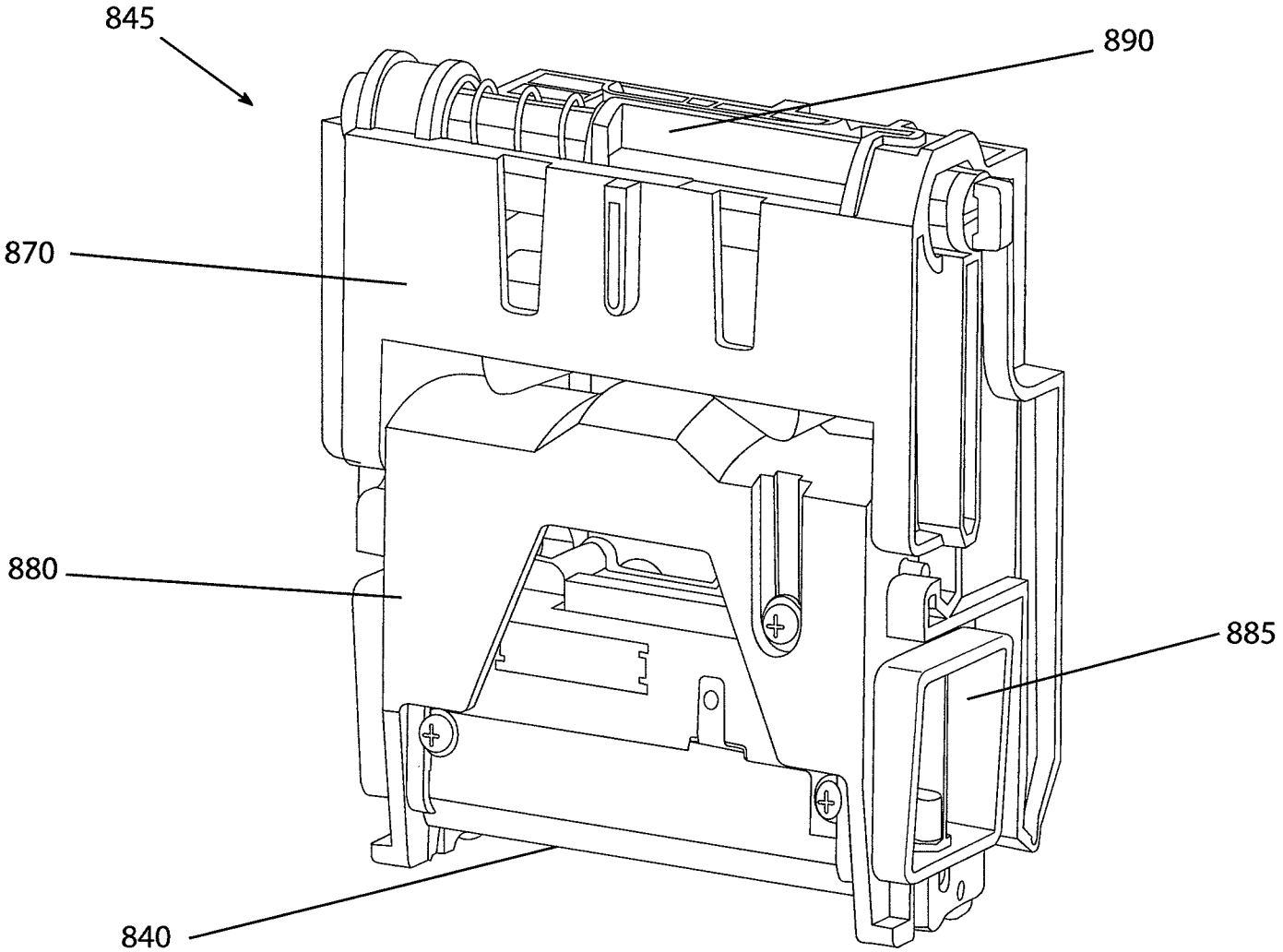
FIG. 13 illustrates a printhead assembly according to an example embodiment of the present invention.

FIG. 13 illustrates the printhead assembly 845 including a support body which includes the printhead bracket 880 as received within the printhead carrier 870. As noted above, the printhead assembly 845 may be easily removable from the printhead guide 850 to aid replacement of a worn or defective printhead. The printhead bracket 880 may be held in place within the printhead guide 850 by the printhead carrier 870; however, the printhead bracket 880 may be permitted a limited degree of movement relative to the printhead carrier 870 to enable the printhead 840 to maintain engagement when processing varying media thicknesses. As such, the printhead bracket 880 may be biased within the printhead carrier 870 to enable a limited degree of movement in the direction of arrow 841 if FIG. 9 while maintaining engagement between the printhead 840 and the media that is to be processed.

The printhead assembly 845 may include a printhead latch mechanism 890 that may latch the printhead assembly 845 in the engaged position. The printhead latch mechanism 890 may be spring biased, as illustrated, to engage a recess within the printhead guide 850 upon being moved to the engaged position. The printhead latch mechanism 890 may retain the printhead assembly 845 in the engaged position when the lid 967 of the printing station module is opened. A user may manually disengage the printhead latch mechanism 890 when the lid 967 is in the open position, thereby releasing the printhead assembly 845 to the disengaged position in which it is biased. Optionally, the latch mechanism 890 may be configured to be released when the lid release button 969 is depressed, thereby disengaging the printhead assembly 845 when opening the lid 967.

The support body, and in particular, the printhead bracket 880 may also include ducts 885 on both sides of the bracket to enable ventilation of the printhead 840. The printhead may benefit from cooling to increase printing efficiency such that ventilation of the printhead is desirable. Ducts 885 arranged on both sides of the printhead within the printhead bracket 880 may allow cross-ventilation of the printhead 840, increasing cooling efficiency and reducing the cooling time required. The ducts 885 may include at least one flow directing surface that is structured to direct the air flow. In the illustrated embodiment of FIG. 13, the duct 885 comprises four flow directing surfaces arranged in a square to guide the air flow.

Figure 13A:
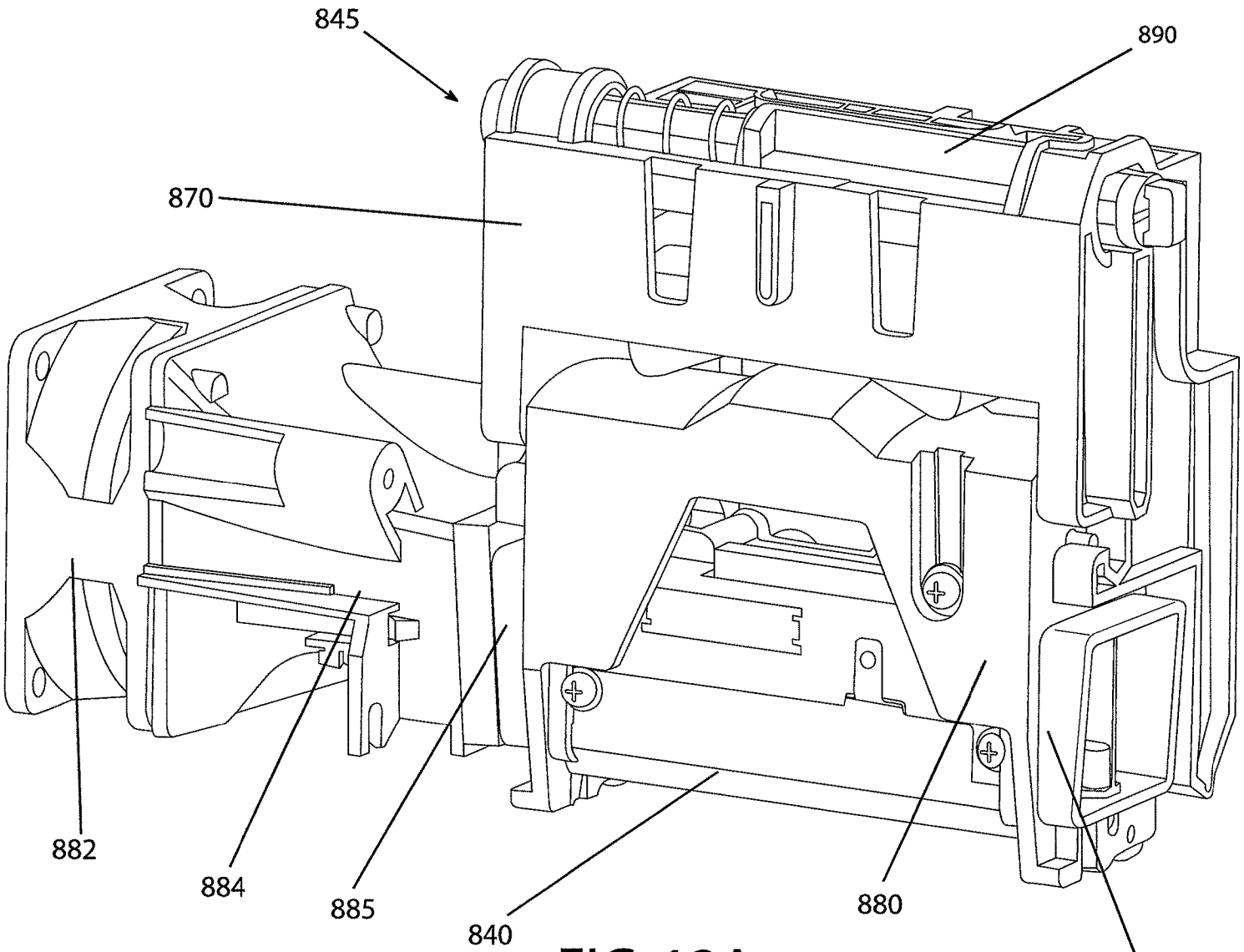
FIG. 13A illustrates the printhead assembly as aligned with an plenum and air flow generating device according to an example embodiment of the present invention.

As illustrated in FIG. 13A, a plenum 884 and fan 882 (or other air flow generating device) may be housed within the printing station module and may be configured to engage a duct 885 when the printhead assembly 845 is in the engaged position. The fan and plenum may be configured to force air through a first duct 885 of the printhead bracket 880, across the printhead 840, and out the opposing duct 885, through air flow channel 781 of the consumable support assembly to further enhance printhead cooling.

The cooling channel between the ducts 885, defined by the printhead 840, the printhead carrier 870, and the printhead bracket 880, may be configured to be isolated from the processing path 425 of the media processing device. The plenum 884 and the flow directing surfaces of the ducts 885 are configured to direct air flow through an air flow channel and isolate the processing path from the air flow channel. Isolation of the cooling air flow path from the processing path may enhance print quality by precluding the forced air of the cooling path to be directed onto the freshly printed substrate, and to avoid carrying dust or debris onto the printed substrate. Further, as it may be desirable to quickly cool the printhead, it may also be important to quickly heat the printhead. Therefore, isolating the cooling path from the printhead element that is heated to perform the printing may be beneficial as the cooling air will not hamper heating of the printhead element.

Figure 13B:
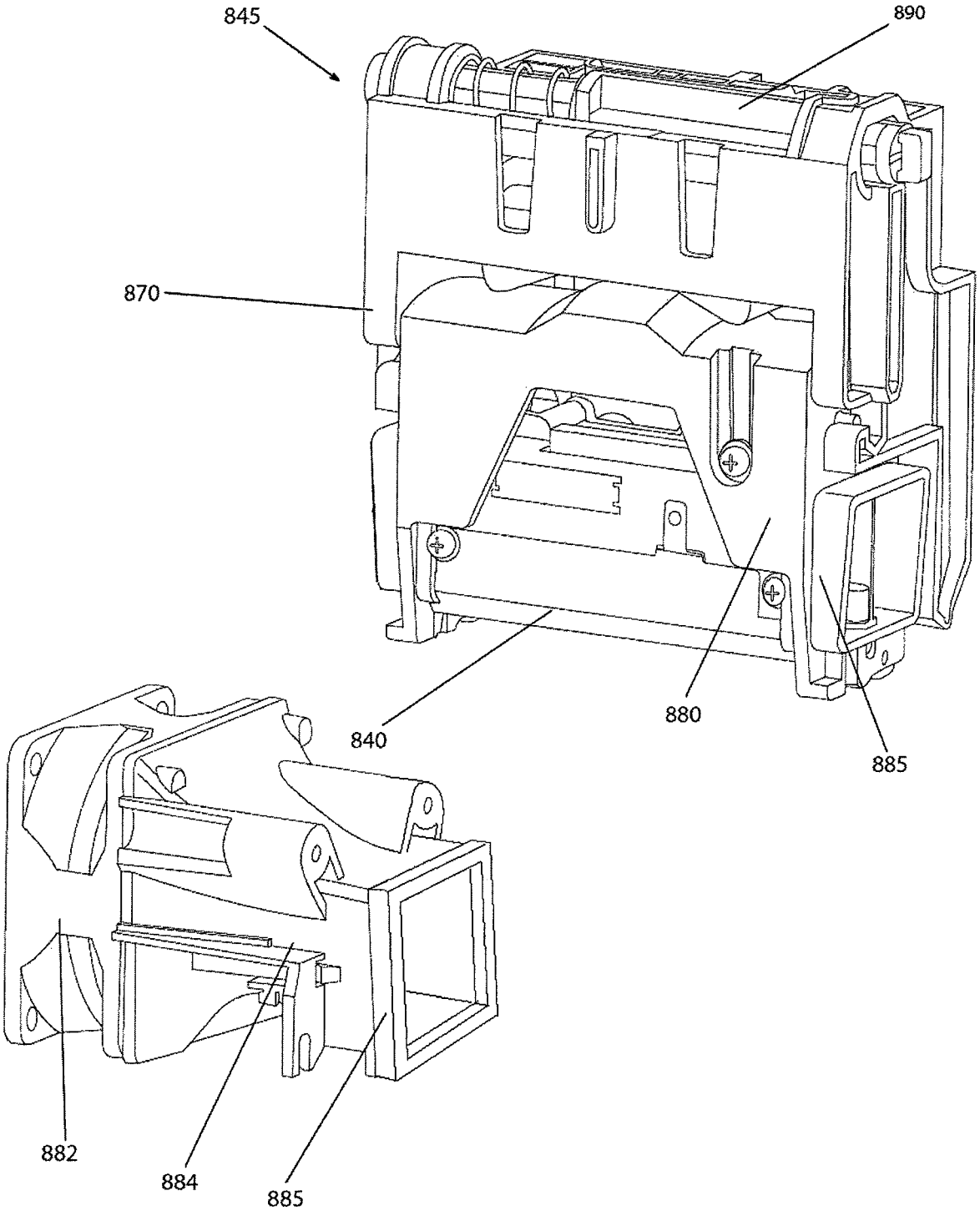
FIG. 13B illustrates the printhead assembly as misaligned with the plenum and air flow generating device according to an example embodiment of the present invention.

While FIG. 13A illustrates the printhead assembly 845 in the engaged position, where the duct 885 is aligned with the plenum 884. When the printhead assembly 845 is moved to the disengaged position, the duct 885 becomes misaligned with the plenum 884 as shown in FIG. 13B.

Figure 14:
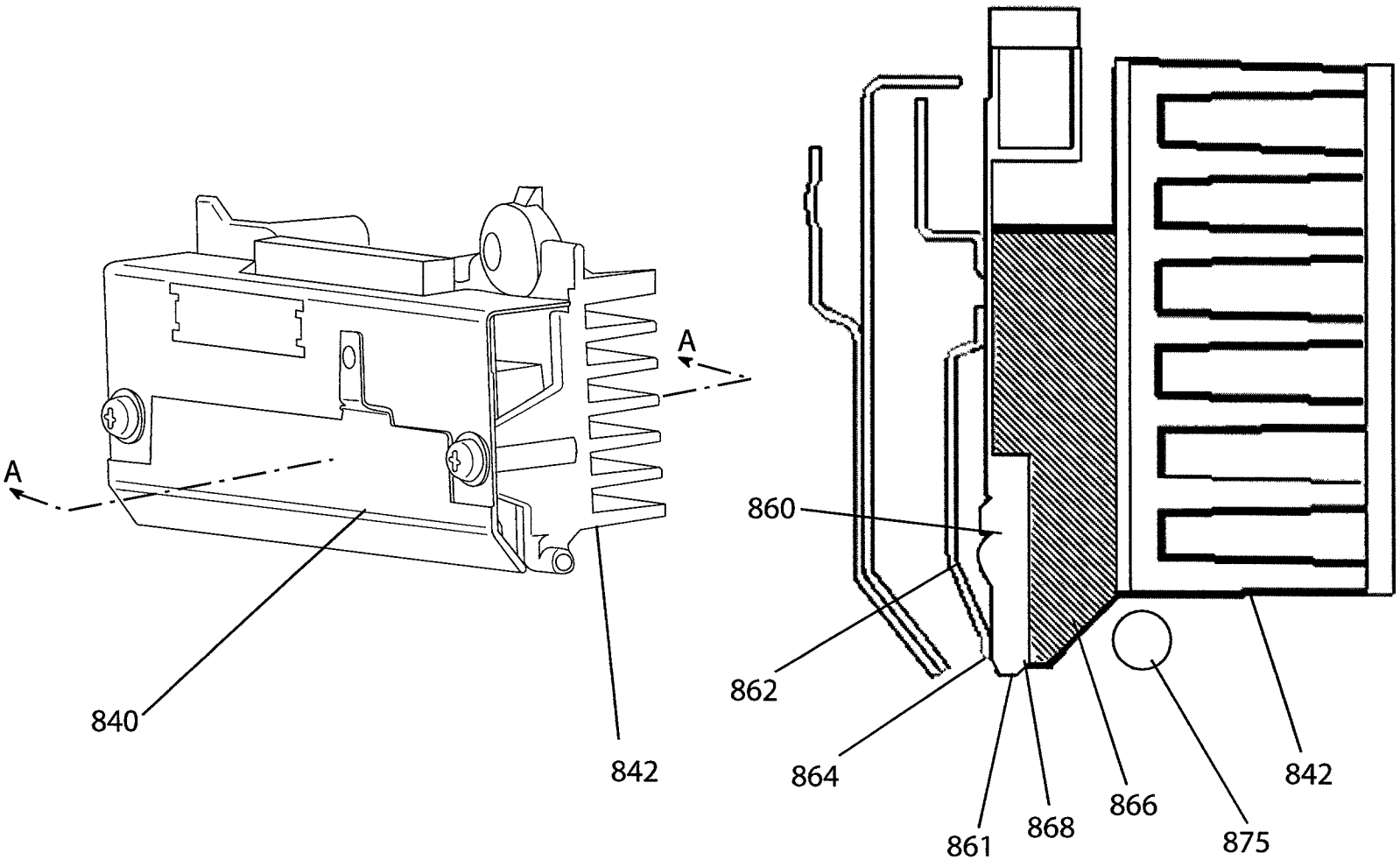
FIG. 14 depicts a printhead and a cross-section of a printhead including a heat sink according to an example embodiment of the present invention.

FIG. 14 depicts the printhead of FIG. 13 as removed from the printhead bracket 880 and a cross-section of that printhead taken along a mid-point of the printhead along section line A-A. The printhead 840 may be readily removable from the printhead bracket 880 and the printhead bracket may be readily removable from the printhead carrier 870 such that a printhead 840 may be replaced without requiring replacement of the printhead bracket and carrier. As the printhead bracket 880 and the printhead carrier 870 may not typically be wear items or consumables, allowing the printhead 840 to be replaced exclusive of the printhead bracket and carrier may reduce maintenance costs and waste.

The printhead 840 may include a thermal printhead element 860 that is heated by an electronic signal received by the printhead and causes the ink of the ribbon to transfer to the media substrate surface. When heated, the ink is transferred at the points along the length of the printhead element 860 that are heated. Each of these points is a pixel or dot and the series of pixels or dots created by each cycle of the printhead element is a printed line. The media may then be advanced such that the next printed line may be printed. Upon completion of the printed image, the adjacent lines and pixels create an image from which the individual printed lines and pixels may be virtually indiscernible. The ability of each point of the printhead element 860 to transition between a heated state in which a pixel is printed and unheated, in which no pixel is printed, is important to the quality and speed of the printing of the printhead element 860. Print quality and speed may be improved by the ability of the printhead element 860 (and in particular, each pixel or dot) to transition between a heated state and an unheated state. To improve this thermal transition, embodiments of the present invention may include improved thermal transfer features.

The printhead 840 may be coupled to a heat sink 842 to help dissipate heat from the printhead 840 and further increase cooling efficiency. The ducts 885 of the printhead bracket 880 (as shown in FIG. 13) may be arranged such that air moving from one duct 885 to another is moved across fins of the heat sink 842. Forcing air across the heat sink 842 using the fan and plenum arrangement noted above may further increase the cooling efficiency of the printhead 840 and may permit faster and higher quality printing. The heat sink 842 may be attached to the printhead 840 in a manner which generates thermal communication between the printhead 840 and the heat sink 842. For example, the heat sink 842 may be secured to the printhead to allow substantial surface contact between a surface of the printhead 840 which is heated and a surface of the heat sink 842 to draw heat from the printhead 840. Further, a thermally conductive surface treatment such as a thermal interface material may be applied between the heat sink 842 and the printhead 840 to further increase the thermal transfer efficiency between the printhead 840 and the heat sink 842.

The printhead element 860 may be in thermal communication with the heat sink 842 by physical contact with a block 866. The block 866 may be a thermally conductive element that absorbs heat from the printhead element 860 and transfer the heat to the heat sink 842 for dissipation through the fins of the heat sink. Thermal communication between the block 866 and the printhead element 860, and between the block 866 and the heat sink 842 may be improved through the use of a thermal interface material. The thermal interface material may have a thermal conductivity of about 3.6 W/m-K as tested according to ASTM D5470. As a paste or a semi-solid, the thermal interface material may create better surface contact or increase the surface contact area between the block 866 and the printhead element 860. The thermal interface material may particularly be present at 868, proximate the print line 861 of the printhead element at which point the heat is concentrated for printing. As the print line 861 is the region of greatest heat of the printhead element 860, the need for heat dissipation in the region of the print line 861 may be greater. The printhead element 860 may further include bracket 862 which is configured to strengthen the printhead element 860 and to help maintain rigidity of the element during printing. The bracket 862 may be used to further dissipate heat from the printhead element by placing the bracket in thermal contact with the printhead element 860 at 864, proximate the print line 861. A thermal interface material 864 may be used to increase the thermal conductivity between the printhead element 860 and the bracket 864.

Figure 15:
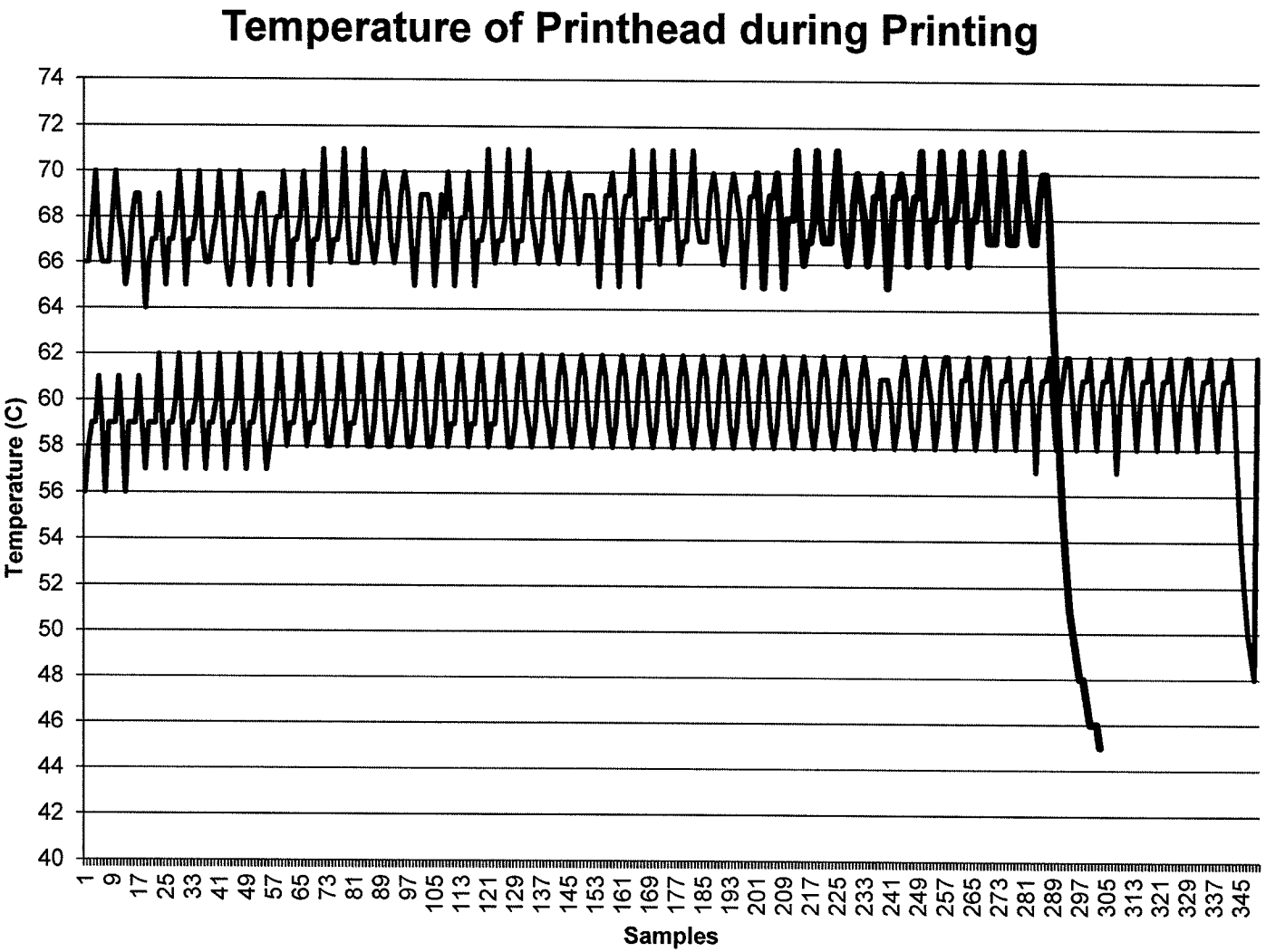
FIG. 15 is a graph of the thermal characteristics during printing of a standard printhead and a printhead implementing improved thermal dissipation features according to example embodiments of the present invention.

FIG. 15 illustrates a graph of the temperature of a printhead measured during printing. As illustrated, the temperature of the printhead was recorded over the printing of a number of samples with the temperature depicted on the Y-axis and the number of samples depicted on the X-axis. The test to produce this data was run while printing fifty full-black media cards at the highest available print speed (300 cards/hour). The printer firmware monitors the temperature measured through the printhead thermistor and outputs the temperature readings during the test. The printers used for the test were substantially similar and the printheads were identical; however, one printhead included a thermal interface material while the other printhead did not. The measured operating temperature of the printhead that did not include the thermal interface material was between 64 and 71 degrees Celsius as shown by the upper line of the plot of FIG. 15. The printhead that did include the thermal interface material measured between 56 and 62 degrees Celsius during the test as shown by the lower line of the plot. Thus, the thermal interface material is demonstrated to substantially improve heat dissipation during the printing operation.

Further illustrated in the section view A-A and in FIG. 10 is a media biasing roller 871. The media biasing roller 871 may be a roller biased toward the media processing path by one or more biasing elements, such as a spring. The media biasing roller 871 may be configured to maintain media alignment as the media is received between the printhead element 860 and the platen roller (877 of FIG. 10), disposed directly beneath the printhead element. When the leading edge of a media substrate is received at the nip between the printhead element 860 and the platen roller, the pressure between the printhead element and the platen roller, together with the rigidity of the media may cause the end of the media substrate opposite the leading edge to lift off of the media processing path 878. The media biasing roller 871 may counteract the rise of the media from the media processing path 878 and hold the media to, or proximate to the media processing path. Maintaining the media on the media processing path may maintain better alignment between the print line 861 and the media, thereby increasing the print quality.

Figure 16:
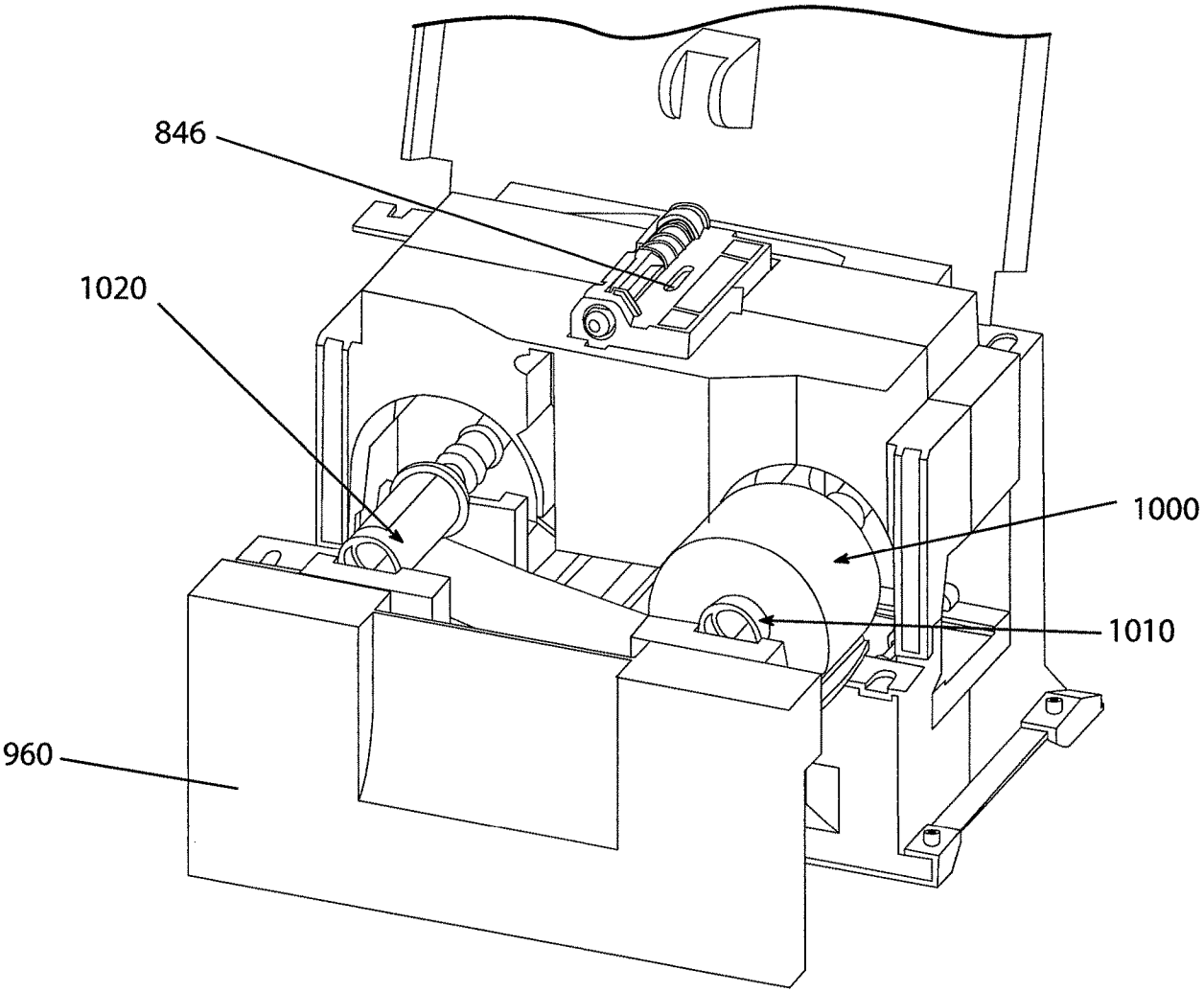
FIG. 16 illustrates a printing station module including a ribbon supply spool and a ribbon take-up spool arranged in a consumable support assembly which is disposed in an open position according to an example embodiment of the present invention.

As outlined above, embodiments of the present invention may be configured to ease installation of a ribbon within a printing station. Described herein is an example embodiment of a process of installation of such a ribbon within a printing station. FIG. 16 illustrates an example embodiment of the present invention in which a ribbon 1000 has been loaded into the consumable support assembly 960. The ribbon supply spool 1000 has been loaded into the ribbon supply spool cradle with the ribbon supply spool core 1010 received within the recesses of the ribbon supply spool cradle. Similarly, the ribbon take up spool core 1020 has been received within the ribbon supply spool cradle with the ends of the core situated in the recesses of the ribbon take-up spool cradle. The printhead assembly 845 is illustrated in the disengaged, raised position for loading of the ribbon 1000. FIG. 17 illustrates the consumable support assembly in a closed position relative to the printing station 965. In the closed position, the ribbon supply spool 1010 is received by the ribbon supply spindle 1015 while the ribbon take-up spool 1020 is received by the ribbon take-up spindle 1025. As noted above, the ribbon spools may be elevated or raised off of their respective cradles in response to the consumable support assembly being inserted into the printing station. The ribbon web is received between the platen roller and the printhead while the printhead assembly is in the disengaged position.

FIG. 18 illustrates the lid 967 in a partially closed position where the bull-nose feature 970 is engaging the printhead assembly 845 along surface 1030. The rounded portion of the bull-nose feature 970 may provide a smooth pressing surface between the printhead assembly 845 and the bull-nose feature 970 as the bull-nose feature moves with the lid 967 along an arc about the hinge 1035. As the lid 967 is closed, the bull-nose feature 970 drives the printhead assembly 845 to the engaged position. Once the lid 967 is closed, the tab 963 precludes the consumable support assembly 960 from opening and the bull-nose feature 970 ensures the printhead assembly 845 is seated in the engaged position, ready to print.

Once the lid 967 drives the printhead assembly 845 to the engaged position, the latch mechanism 890 may engage a recess 891 of the printhead guide to retain the printhead assembly 845 in the engaged position. The lid release button 969 may be configured such that, in response to the lid release button 969 being depressed, the latch mechanism 890 of the printhead assembly is moved to the unlatched position, releasing the printhead assembly to the disengaged position. As the printhead assembly 845 is biased toward the disengaged position, the biasing assembly may drive the printhead assembly 845 upward, thereby driving the lid 967 toward the open position by virtue of the driving surface 1030 engaging the bull-nose feature 970. Thus, the biasing assembly may indirectly bias the lid 967 toward the open position.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe some example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A printhead assembly structured to be removably received into a printhead guide of a media processing device having a platen and a biasing assembly, the printhead assembly comprising:

a printhead; and a support body adapted to support the printhead, wherein the support body is structured to slidably translate within the printhead guide between a disengaged position, where the printhead is removed from the platen, and an engaged position, wherein the printhead is positioned proximate the platen, and wherein the support body defines an interface member structured to removably engage the biasing assembly, wherein the biasing assembly is structured to bias the support body in the disengaged position, wherein the media processing device further comprises a lid movable between an open position and a closed position, and wherein the support body defines a drive surface that is engaged by the lid to drive the support body against the bias of the biased carrier to the engaged position as the lid transitions between the open position and the closed position.

2. The printhead assembly of claim 1, wherein the printhead is disposed in thermal communication with a heat sink, and wherein the support body defines a duct structured to pass an air flow over the heat sink.

3. The printhead assembly of claim 2, wherein the duct comprises at least one flow directing surface that is structured to direct the air flow over the heat sink while at least partly isolating the air flow from the printhead.

4. The printhead assembly of claim 1, wherein the printhead assembly further comprises a latch that is configurable between a latched position, wherein the printhead is maintained in the engaged position, and an unlatched position, wherein the printhead is free to move to the disengaged position.

5. The printhead assembly of claim 4, wherein the latch is biased toward the latched position.

6. The printhead assembly of claim 1, wherein the support body comprises a printhead carrier and a printhead bracket.

7. The printhead assembly of claim 6, wherein the printhead bracket supports the printhead and is structured to be removably coupled to the printhead carrier.

8. The printhead assembly of claim 7, wherein the printhead is disposed in thermal communication with a heat sink, and wherein the printhead bracket defines a duct structured to pass an air flow over the heat sink.

9. The printhead assembly of claim 8, wherein the duct comprises at least one flow directing surface that is structured to direct the air flow over the heat sink while at least partly isolating the air flow from the printhead.

10. The printhead assembly of claim 1 further comprising a printhead interface disposed in electrical communication with the printhead, wherein the printhead interface is positioned to engage a controller interface of the media processing device when the support body is disposed in the engaged position.

11. The printhead assembly of claim 10, wherein the printhead interface is positioned to disengage from the controller interface of the media processing device when the support body is disposed in the disengaged position.

12. The printhead assembly of claim 4, wherein the latch is moved from the latch position to the unlatched position via movement of the lid.

13. The printhead assembly of claim 1, wherein the printhead is removeable from the media processing device without disconnecting the biasing assembly.

14. The printhead assembly of claim 1, wherein the lid comprises a nose feature configured to engage the drive surface when the lid is closed.

15. The printhead assembly of claim 1, wherein the printhead assembly is removeable from the printhead guide by sliding the printhead assembly within the printhead guide in a direction away from a base of the media processing device.

16. The printhead assembly of claim 1, wherein the lid comprises a lid release button wherein the lid is configured to open when the lid release button is pressed; and when the lid is opened, the support body moves to a disengaged position.

* * * * *